US005722363A

United States Patent [19]

Iida et al.

[11] Patent Number: 5,722,363

[45] Date of Patent: Mar. 3, 1998

[54] CYLINDER-INJECTION TYPE INTERNAL COMBUSTION ENGINE AND A FUEL INJECTION CONTROL APPARATUS THEREFOR

[75] Inventors: Kazumasa Iida; Yasuki Tamura; Shogo Omori; Katsuhiko Miyamoto; Masato Yoshida; Yuichi Tonomura; Jun Aoki, all of Tokyo, Japan

[73] Assignee: Mitsubishi Jidosha Kogyo Kabushiki Kaisha, Tokyo, Japan

[21] Appl. No.: 765,791

[22] PCT Filed: May 15, 1996

[86] PCT No.: PCT/JP96/01284

§ 371 Date: Apr. 15, 1997

§ 102(e) Date: Apr. 15, 1997

[87] PCT Pub. No.: WO96/36801

PCT Pub. Date: Nov. 21, 1996

[30] Foreign Application Priority Data

May 15, 1995 [JP] Japan ..... 7-115775
May 15, 1995 [JP] Japan ..... 7-115776

[51] Int. Cl.[6] ..... F02B 5/00

[52] U.S. Cl. ..... 123/305

[58] Field of Search ..... 123/305, 276, 123/675, 436, 680, 679, 682

[56] References Cited

U.S. PATENT DOCUMENTS

| | | | |
|---|---|---|---|
| 5,170,759 | 12/1992 | Ito | 123/276 |
| 5,205,254 | 4/1993 | Ito et al. | 123/305 |
| 5,628,290 | 5/1997 | Iida et al. | 123/305 |
| 5,642,706 | 7/1997 | Wirth et al. | 123/305 |

FOREIGN PATENT DOCUMENTS

| | | | |
|---|---|---|---|
| 579370 | 3/1993 | Japan | 123/305 |

*Primary Examiner*—Raymond A. Nelli

[57] ABSTRACT

A fuel injection control apparatus for a cylinder-injection type internal combustion engine performs a switching of fuel injection control modes in accordance with the operating state of the internal combustion engine when the engine is operating in a steady state. When the internal combustion engine is operating in a transitional state, for example, when the engine is accelerating or decelerating, a fuel injection control mode suited for the transitional operating state is selected preferentially over the mode selection for a steady state by a fuel injection control mode switching means. Consequently, the fuel injection control apparatus permits desirable operation of the internal combustion engine, making it possible to greatly improve the drivability of a vehicle in which the engine is installed.

44 Claims, 18 Drawing Sheets

CYLINDER-INJECTION TYPE INTERNAL COMBUSTION ENGINE AND A FUEL INJECTION CONTROL APPARATUS THEREFOR

TECHNICAL FIELD

This invention relates to a cylinder-injection type internal combustion engine suited for use in a motor vehicle and to a fuel injection control apparatus for such an engine.

BACKGROUND ART

In recent years, cylinder-injection type internal combustion engines are under development for use as internal combustion engines for motor vehicles. In such cylinder-injection type internal combustion engines, fuel is injected directly into combustion chambers, that is, cylinders of the engine, and therefore, various measures are adopted to cause a mixture of air and fuel having an air-fuel ratio close to the stoichiometric ratio to be formed only in the vicinity of a spark plug. Thus, even if the mixture fed into a cylinder of the cylinder-injection type internal combustion engine is lean as a whole, that is, even if an average air-fuel ratio is greater than the stoichiometric ratio, fuel can be ignited so that it can be satisfactorily burned. As a result, carbon monoxide (CO) and hydrocarbons (HC) contained in the exhaust gas from the internal combustion engine are reduced, and it is also possible to greatly cut down the consumption of fuel during idling operation of the internal combustion engine or when a motor vehicle equipped with the engine is traveling in steady condition. In an ordinary type internal combustion engine in which fuel is injected to an intake passage, a mixture is produced in the intake passage, and accordingly, there is a time lag before the mixture actually flows into the cylinder. In the case of the cylinder-injection type internal combustion engine, by contrast, no such time lag occurs, providing excellent response characteristics with respect to acceleration and deceleration of the internal combustion engine.

This advantage of the cylinder-injection type internal combustion engine is, however, available only when the engine is operated in relatively low-load condition. Specifically, when the quantity of fuel injection is increased as the load on the internal combustion engine increases, the mixture produced around the spark plug becomes excessively rich, so that the fuel cannot be ignited, causing misfire. Namely, with the cylinder-injection type internal combustion engine, it is difficult to produce a mixture having an optimum air-fuel ratio only in the vicinity of the spark plug over the entire operating region.

To overcome the drawback, Unexamined Japanese Patent Publication (KOKAI) No. 5-79370 discloses a cylinder-injection type internal combustion engine which has, as fuel injection modes, a former-stage injection mode in which fuel is injected during the suction stroke and a latter-stage injection mode in which fuel is injected during the compression stroke, and the switching between the former- and latter-stage injection modes is controlled in accordance with the load on the engine. In the latter-stage injection mode, fuel injected creates a mixture having an air-fuel ratio close to the stoichiometric ratio only in the vicinity of the spark plug. Therefore, even if the mixture in the cylinder is lean as a whole, the fuel can be ignited, making it possible to reduce CO and HC in the exhaust gas. Also, the consumption of fuel can be greatly cut down when the internal combustion engine is idling or the vehicle is traveling in steady condition. In the former-stage injection mode, on the other hand, fuel is injected during the suction stroke and a mixture having a uniform concentration of fuel throughout the cylinder is formed. Consequently, the air utilization factor is high, whereby the quantity of fuel injection can be increased, making it possible to fully enhance the output of the internal combustion engine.

Thus, in the above cylinder-injection type internal combustion engine known in the art, although the fuel injection mode is switched to the latter- or former-stage injection mode in accordance With steady operating state, no consideration is given to transitional operating states such as at vehicle start, acceleration, deceleration or during cold state. Therefore, when the internal combustion engine is operating in a transitional state, the fuel injection mode or the average air-fuel ratio in the cylinder may fail to be properly set, in which case the performance of the engine as the automotive engine cannot be fully achieved.

This invention was created in view of the above circumstances, and an object thereof is to provide a fuel injection control apparatus for a cylinder-injection type internal combustion engine wherein, even when the engine is operating in a transitional state, control of the fuel injection mode or of the average air-fuel ratio can be optimized in accordance with such a transitional operating state.

DISCLOSURE OF THE INVENTION

The above object is achieved by a fuel injection control apparatus for a cylinder-injection type internal combustion engine according to this invention, which comprises: operating state detecting means for detecting operating states of the internal combustion engine; control mode switching means for performing a switching between a former-stage injection control mode in which fuel is injected during a suction stroke and a latter-stage injection control mode in which fuel is injected during a compression stroke, in accordance with a detection result provided by the operating state detecting means; transitional state detecting means for detecting transitional operating states of the internal combustion engine; and control mode selecting means, which takes priority over the control mode switching means when a transitional operating state of the internal combustion engine is detected by the transitional state detecting means, for selecting a fuel injection control mode suited for the detected transitional operating state.

With the above fuel injection control apparatus, when the internal combustion engine is operating in a transitional state, the control mode selecting means takes priority over the control mode switching means to select a fuel injection control mode suited for the transitional operating state. Consequently, the fuel injection control apparatus permits desirable operation of the internal combustion engine, making it possible to greatly improve the drivability of a vehicle in which the engine is installed.

The fuel injection control apparatus can be applied to an internal combustion engine whose operating states include a fuel-cut region in which injection of fuel is suspended under a predetermined operation condition. In this case, the transitional state detecting means of the fuel injection control apparatus detects, as one of the transitional operating states to be detected, a transitional recovering state in which operation of the internal combustion engine recovers from the fuel-cut region, and the control mode selecting means sustains the injection control mode selected thereby for a predetermined time period when the transitional recovering state is detected by the transitional state detecting means, in such a manner that in the selected injection control mode, an air-fuel ratio is set to a value greater than a stoichiometric air-fuel ratio. According to this fuel injection control apparatus, when operation of the internal combustion engine recovers from the fuel-cut region, the mixture of air and fuel formed in the cylinder is kept lean for the predetermined time period. Therefore, in such a situation, the output torque of the internal combustion engine never suddenly increases, whereby vibration of the vehicle body attributable to roll of the engine can be substantially reduced.

The transitional state detecting means of the fuel injection control apparatus can detect, as one of the transitional operating states to be detected, a first transitional accelerating state in which operation of the internal combustion engine changes from a decelerating state to an accelerating state. In this case, the control mode selecting means sustains the injection control mode selected thereby for a predetermined time period when the first transitional accelerating state is detected by the transitional state detecting means, in such a manner that in the selected injection control mode, an air-fuel ratio is set to a value greater than a stoichiometric air-fuel ratio. Specifically, the transitional state detecting means includes load information detecting means for detecting load information of the internal combustion engine, opening information detecting means for detecting a change in opening of a throttle valve of the internal combustion engine, and judging means for judging that the internal combustion engine is in the first transitional accelerating state when the load information detected by the load information detecting means shows a change in a positive direction beyond a predetermined negative value and also the change in opening of the throttle valve detected by the opening information detecting means indicates a change in a positive direction beyond a predetermined positive value. With this fuel injection control apparatus, when operation of the internal combustion engine changes from deceleration to acceleration, the mixture formed in the cylinder is kept lean for the predetermined time period. Therefore, in such a situation, the output of the internal combustion engine never suddenly increases, and thus acceleration shock of a vehicle equipped with the engine can be lessened. In this case, a change from a decelerating state to an accelerating state of the internal combustion engine can be accurately detected because the detection is made based on the throttle opening and the load information of the engine, whereby acceleration shock of the vehicle can be reduced with reliability.

The transitional state detecting means of the fuel injection control apparatus can detect, as one of the transitional operating states to be detected, a transitional decelerating state in which operation of the internal combustion engine changes to a decelerating state. In this case, the control mode selecting means sustains the injection control mode selected thereby for a predetermined time period when the transitional decelerating state is detected by the transitional state detecting means, in such a manner that in the selected injection control mode, an air-fuel ratio is set to a value greater than a stoichiometric air-fuel ratio. Specifically, the transitional state detecting means includes opening information detecting means for detecting a change in opening of a throttle valve of the internal combustion engine, and judging means for judging that the internal combustion engine is in the transitional decelerating state when the change in opening of the throttle valve detected by the opening information detecting means indicates a change in a negative direction beyond a predetermined negative value. With this fuel injection control apparatus, when the internal combustion engine, that is, the vehicle, is going to decelerate, the mixture formed in the cylinder is kept lean for the predetermined time period, and thus deceleration shock of the vehicle can be lessened. In this case, a transition to a decelerating state of the internal combustion engine can be accurately detected because the detection is made based on the throttle opening, whereby deceleration shock of the vehicle can be reduced with reliability.

In the above fuel injection control apparatus, when the engine is operating in a transitional state, the latter-stage injection control mode is selected as the injection control mode. In this case, fuel is injected during the compression stroke and the air-fuel ratio is set to a value greater than the stoichiometric air-fuel ratio. As a result, the mixture can be made lean without increasing harmful components in the exhaust gas from the internal combustion engine, making it possible to cut down the fuel consumption.

The transitional state detecting means of the fuel injection control apparatus can detect, as one of the transitional operating states to be detected, a second transitional accelerating state in which operation of the internal combustion engine changes from a state other than a decelerating state to an accelerating state. In this case, the control mode selecting means selects the former-stage injection control mode as the injection control mode for a predetermined time period when the second transitional accelerating state is detected by the transitional state detecting means. Specifically, the transitional state detecting means includes opening information detecting means for detecting a change in opening of a throttle valve of the internal combustion engine, and judging means for judging that the internal combustion engine is in the second transitional accelerating state when the change in opening of the throttle valve detected by the opening information detecting means indicates a change in a positive direction beyond a predetermined positive value. With this fuel injection control apparatus, when operation of the internal combustion engine, that is, the vehicle, changes from a constant-speed running state to acceleration or from an accelerating state to an even more accelerating state, fuel is injected during the suction stroke, whereby acceleration response of the vehicle equipped with the engine can be remarkably improved.

The aforementioned predetermined time period can be set as a number of strokes of the internal combustion engine, and preferably in this case, the number of strokes takes a greater value with increase in rotational speed of the internal combustion engine. With this fuel injection control apparatus, the selection of an injection control mode by the control mode selecting means remains effective for a time period corresponding to a predetermined number of strokes while the internal combustion engine is operating in a transitional state. Accordingly, when the internal combustion engine is operating in a transitional state, the control time for the selected injection control mode is optimally determined in accordance with the transitional operating state. Namely, since the number of strokes is increased with increase in the rotational speed of the engine, a sufficient control time can be ensured for the selected injection control mode even when the rotational speed of the internal combustion engine is high.

The transitional state detecting means of the fuel injection control apparatus can detect, as one of the transitional operating states to be detected, a transitional starting state in which a vehicle equipped with the internal combustion engine is going to start. In this case, the control mode selecting means selects the former-stage injection control mode as the injection control mode for a predetermined time period when the transitional starting state is detected by the transitional state detecting means. With this fuel injection control apparatus, when the vehicle equipped with the internal combustion engine is going to start, fuel is injected according to the former-stage injection control mode, and therefore, the engine produces sufficient torque, permitting the vehicle to start smoothly. At this time, by controlling the air-fuel ratio to the stoichiometric air-fuel ratio, harmful components in the exhaust gas can be effectively purified by a three-way catalyst.

The fuel injection control apparatus may further comprise stop detecting means for detecting a stopped state of the vehicle. In this case, the control mode switching means of the fuel injection control apparatus switches the injection control mode to the latter-stage injection control mode when the stopped state of the vehicle is detected by the stop detecting means. With this fuel injection control apparatus, when the vehicle equipped with the internal combustion engine is in a stopped state, fuel is injected according to the latter-stage injection control mode. Consequently, the mixture formed in the cylinder can be made lean without increasing harmful components in the exhaust gas, making it possible to cut down the fuel consumption.

The transitional state detecting means of the fuel injection control apparatus may include vehicle speed detecting means for detecting a speed of the vehicle, idle detecting means for detecting an idling state of the internal combustion engine, and start judging means for judging that the vehicle is in the transitional starting state when the vehicle speed detected by the vehicle speed detecting means is lower than a predetermined value and also the idling state of the internal combustion engine is not detected by the idle detecting means. In this case, the transitional state detecting means can detect a stopped state of the vehicle with accuracy.

The above stop detecting means may include vehicle speed detecting means for detecting a speed of the vehicle, idle detecting means for detecting an idling state of the internal combustion engine, and stop judging means for judging that the vehicle is in the stopped state when the vehicle speed detected by the vehicle speed detecting means is lower than a predetermined value and also the idling state of the internal combustion engine is detected by the idle detecting means. In this case, the stop detecting means can detect a start of the vehicle with accuracy.

The fuel injection control apparatus may further comprise start completion detecting means for detecting completion of start of the vehicle, and means for causing the control mode switching means to switch the fuel injection control mode when the completion of start of the vehicle is detected by the start completion detecting means. With this fuel injection control apparatus, when a start of the vehicle is completed, the fuel injection control mode is switched in accordance with the operating state of the internal combustion engine. Accordingly, fuel injection can be optimally controlled during travel of the vehicle.

The aforementioned start completion detecting means includes vehicle speed detecting means for detecting a speed of the vehicle, and judging means for judging that the start of the vehicle is completed when the vehicle speed detected by the vehicle speed detecting means has become greater than a predetermined value. In this case, the start completion detecting means can detect completion of a start of the vehicle with accuracy.

With the aforementioned fuel injection control apparatus, while the vehicle is stopped, fuel is injected during the compression stroke. However, when the vehicle which is standing still is going to start, the fuel injection control mode is switched from the latter-stage injection control mode to the former-stage injection control mode, so that fuel is injected during the suction stroke.

An internal combustion engine to which this invention is applied may further comprise an electric low-pressure pump capable of feeding fuel of a predetermined pressure toward the internal combustion engine, a high-pressure pump, driven mechanically by the internal combustion engine, for feeding fuel of a higher pressure than the predetermined pressure toward the internal combustion engine, and fuel-pressure switching means having a first operating position for supplying low-pressure fuel to the internal combustion engine and a second operating position for supplying high-pressure fuel to the internal combustion engine, and switched to one of the first and second operating positions in accordance with the operating state of the internal combustion engine. In this case, the transitional state detecting means of the fuel injection control apparatus can detect, as one of the transitional operating states to be detected, a pressure transition state in which the fuel-pressure switching means is situated at the first operating position, and the control mode selecting means selects the former-stage injection control mode as the injection control mode for a predetermined time period when the pressure transition state is detected by the transitional state detecting means. With this fuel injection control apparatus, when the pressure of fuel supplied to the internal combustion engine is low, fuel is injected during the suction stroke. Namely, fuel is injected according to the former-stage injection control mode when the pressure of fuel supplied to the internal combustion engine is low, whereby fuel injection is performed with reliability and backward flow of fuel never occurs in the fuel supply system.

This invention can also be applied to an internal combustion engine for a vehicle which is provided with a clutch coupling the engine and a manual transmission and having a two-stage torsion characteristic, and transmission temperature detecting means for detecting a temperature of the manual transmission. In this case, the transitional state detecting means of the fuel injection control apparatus can detect, as one of the transitional operating states to be detected, a transmission temperature transition state in which the transmission temperature detected by the transmission temperature detecting means falls within a predetermined range, and the control mode selecting means selects the former-stage injection control mode as the injection control mode when the transmission temperature transition state is detected by the transitional state detecting means. Specifically, the transmission temperature detecting means detects the temperature of lubricating oil in the manual transmission. With this fuel injection control apparatus, when the temperature of the transmission is lower than a predetermined temperature, fuel is injected during the suction stroke. In this case, since fluctuation of the rotational speed of the internal combustion engine can be reduced, vibration transmitted from the engine to the manual transmission via the clutch lessens, whereby the manual transmission does not make a rattling noise.

The operating state detecting means of the fuel injection control apparatus may include cold-state detecting means for detecting a cold state of the internal combustion engine, load information detecting means for detecting load information of the internal combustion engine, and engine rotational speed detecting means for detecting a rotational speed of the internal combustion engine. In this case, the transitional state detecting means of the fuel injection control apparatus can detect, as one of the transitional operating states to be detected, a first transitional cooling state in which the cold state of the internal combustion engine is detected by the cold-state detecting means and also the load information detected by the load information detecting means has become smaller than a predetermined value. When the first transitional cooling state is detected by the transitional state detecting means, the control mode selecting means selects the latter-stage injection control mode as the injection control mode. Preferably, in this latter-stage injection mode, fuel injection is terminated in an initial stage of the compression stroke. With this fuel injection control apparatus, when the internal combustion engine is operated in a cold state and at low load, fuel injected in the initial stage of the compression stroke can vaporize sufficiently by the time the subsequent expansion stroke starts. Consequently, fuel burns satisfactorily and thus smoke in the exhaust gas can be greatly reduced.

The operating state detecting means of the fuel injection control apparatus may include intake air temperature detecting means for detecting an intake air temperature of the internal combustion engine, and cold-state detecting means for detecting a cold state of the internal combustion engine. In this case, the transitional state detecting means of the fuel injection control apparatus includes varying means for varying a threshold of the cold-state detecting means, which threshold is used for detecting the cold state of the internal combustion engine, in accordance with the intake air temperature detected by the intake air temperature detecting means, and can detect, as one of the transitional operating states to be detected, a second transitional cooling state in which the cold state of the internal combustion engine is detected by the cold-state detecting means. The control mode selecting means of the fuel injection control apparatus selects the former-stage injection control mode as the injection control mode when the second transitional cooling state is detected by the transitional state detecting means. With this fuel injection control apparatus, when the internal combustion engine is in a cold state and the intake air temperature is low, fuel is injected during the suction stroke. Consequently, warm-up of the internal combustion engine can be completed quickly, whereby the drivability of the vehicle equipped with the engine improves and the heating system of the vehicle can be effectively operated.

Preferably, the aforementioned control mode selecting means includes determining means for preferentially selecting the injection control mode by giving priority in order of the pressure transition state, the transitional negative pressure decreasing state, the first transitional cooling state, the second transitional cooling state, the transmission temperature transition state, the transitional starting state, the second transitional accelerating state, and the transitional recovering state. With this fuel injection control apparatus, the starting and braking performance of the internal combustion engine is preferentially taken into account when the fuel injection control mode is selected in accordance with a transitional operating state of the engine. As a result, the fuel injection control for the internal combustion engine is optimized, and the drivability of the vehicle can be improved.

The above object of this invention can of course be achieved by a cylinder-injection type internal combustion engine having the function of the above-described fuel injection control apparatus.

BEST MODE OF CARRYING OUT THE INVENTION

System Arrangement

Figure 1:
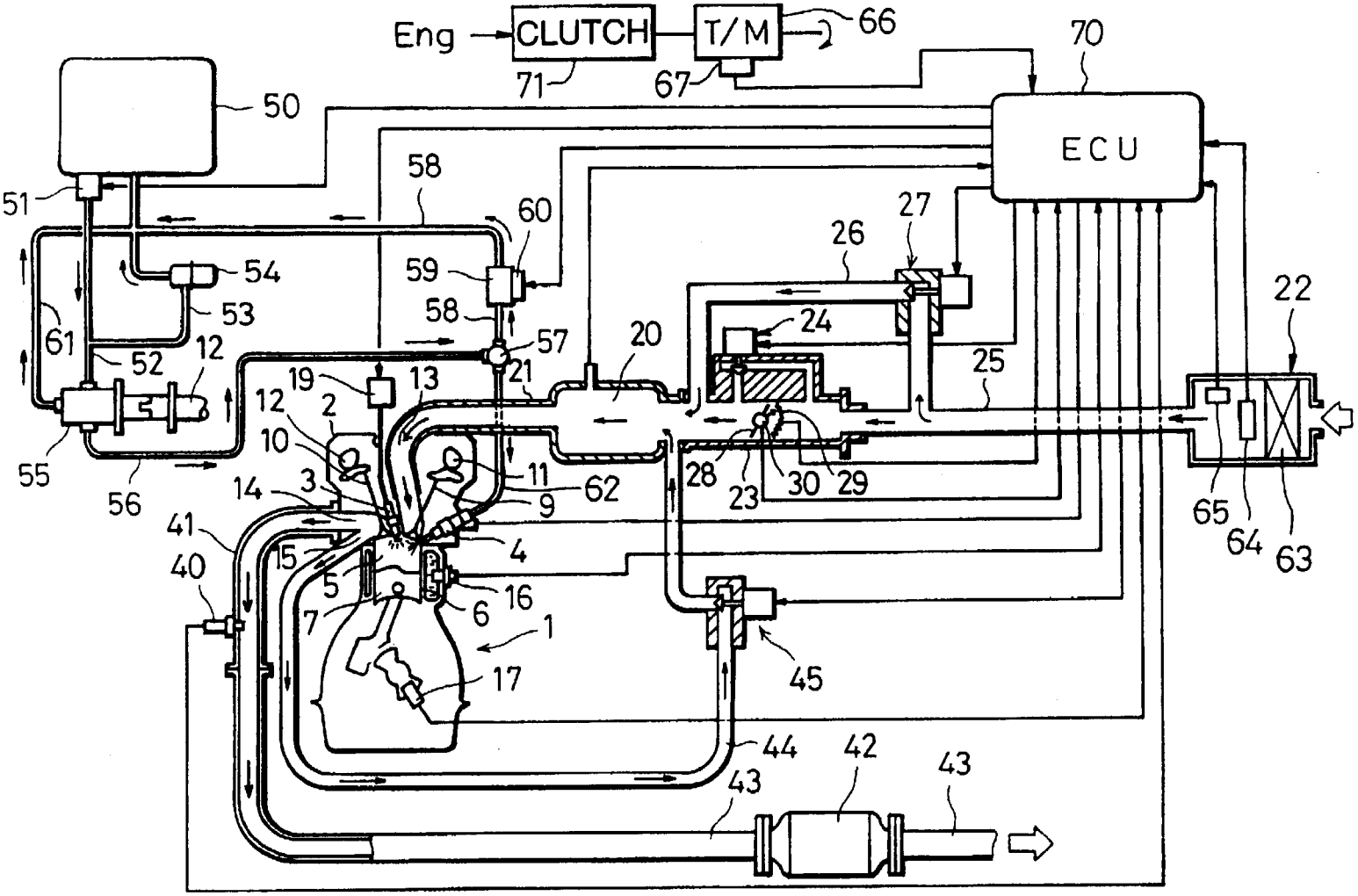
FIG. 1 is a diagram schematically showing an arrangement of an engine system.
Figure 2:
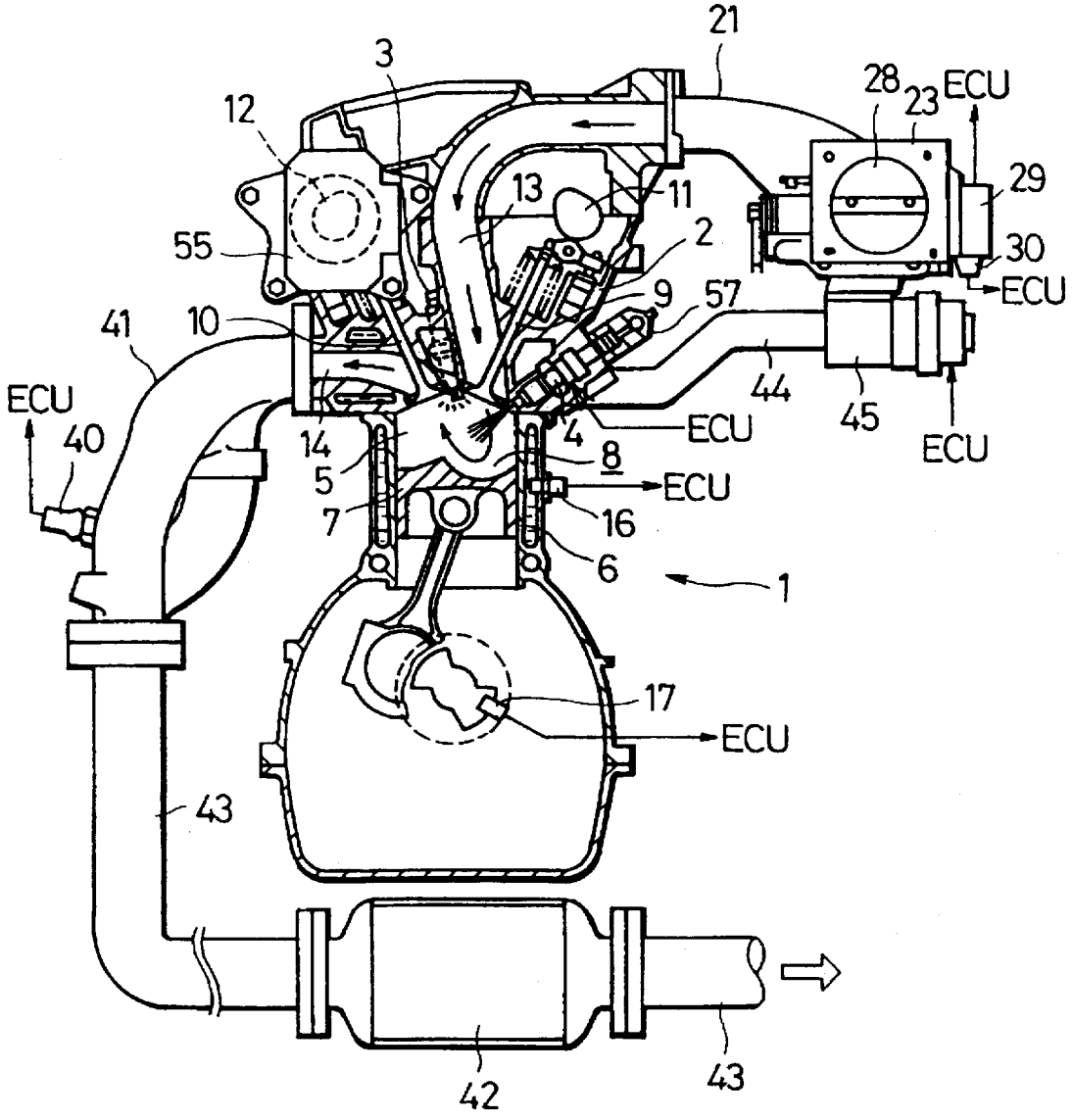
FIG. 2 is an enlarged view of an engine in FIG. 1 and its peripheral parts.

Referring to FIG. 1, an engine system for a motor vehicle is equipped with a cylinder-injection type in-line four-cylinder four-cycle gasoline engine 1 (hereinafter merely referred to as "engine"), and FIG. 2 shows an enlarged view of this engine 1. The engine 1 has a cylinder head 2, a cylinder block and an oil pan, and four cylinder bores 6 are formed in the cylinder block. A piston 7 is received in each cylinder bore 6 and is coupled to a crankshaft by a connecting rod. The cylinder head 2 is provided, for each of the cylinder bores 6, with a spark plug 3, a solenoid valve-type fuel injector 4, a pair of intake valves 9, and a pair of exhaust valves 10. The spark plug 3 is electrically connected to an ignition coil 19 (see FIG. 1), which can apply a high voltage to the spark plug 3.

Each fuel injector 4 injects atomized fuel directly into a combustion chamber 5 defined in the corresponding cylinder bore 6 between the top face of the piston 7 and the cylinder head 2. More specifically, a semispherical cavity 8 is formed in the top face of each piston 7 at a location close to the fuel injector 4. Accordingly, as atomized fuel is injected from the fuel injector 4 when the piston 7 reaches a position near the top dead center, the fuel is received in the cavity 8.

Compared with an ordinary type engine in which fuel is injected into the intake passage, the cylinder-injection type engine 1 has a high compression ratio which is set, for example, to about 12 (twelve). Therefore, the engine 1 can provide high output as compared with the ordinary type engine.

The engine 1 is provided with a double overhead cam (DOHC) type valve actuating mechanism, which has intake and exhaust camshafts 11 and 12 associated respectively with the intake and exhaust valves 9 and 10 for actuating the intake and exhaust valves 9 and 10, respectively, of the individual cylinders. The camshafts 11 and 12 are rotatably supported by the cylinder head 2.

The cylinder head 2 has intake passages 13 and exhaust passages 14 formed therein corresponding to the intake and exhaust valves 9 and 10, respectively, of the individual cylinders. Each intake passage 13 extends straight at a location between the camshafts 11 and 12 along the axis of the corresponding cylinder bore 6. More specifically, as seen from FIG. 2, each intake passage 13 is inclined at a predetermined angle with respect to the axis of the corresponding cylinder bore 6. Each of the intake passages 13 is connected at one end opening thereof to combustion chamber 5, thereby forming an intake port opened and closed by the intake valve 9, and is connected at the other end thereof to an intake manifold 21. Accordingly, a pair of intake ports opens to the combustion chamber 5 of each cylinder, and the fuel injector 4 has its nozzle located between the two intake ports. Since each intake passage 13 extends straight along the axis of the corresponding cylinder bore 6 as mentioned above, intake air flowing into the cylinder via the intake passage 13 forms a reverse tumble flow inside the cylinder with the aid of the cavity 8 of the piston 7, and also the inertia effect of the intake air introduced to the cylinder is enhanced, whereby the engine output can be improved.

A water jacket is formed in the cylinder block, and cooling water is circulated through the water jacket. A water temperature sensor 16 for detecting the temperature of the cooling water is mounted on the cylinder block.

In the crankcase are arranged electromagnetic crank angle sensors 17 for detecting the crank angles of the respective cylinders. In this embodiment, each crank angle sensor 17 outputs a crank angle signal SGT when the crank angle of the corresponding cylinder coincides with each of first and second angular positions. The first and second angular positions are, in this embodiment, set to 75° (75° TDC) and 5° (5° TDC) before the top dead center (TDC) of the piston 7, respectively, based on the angle of rotation of the crankshaft.

A cylinder discrimination sensor is mounted on one of the intake and exhaust camshafts 11 and 12, for example, on the intake camshaft 11, and outputs a cylinder discrimination signal SGC at each of reference rotational angles, based on the angle of rotation of the camshaft 11.

Unlike the intake passages 13, each exhaust passage 14 extends in a direction perpendicular to the axis of the corresponding cylinder bore 6. Each of the exhaust passages 14 is connected at one end opening thereof to the corresponding combustion chamber 5, thereby forming an exhaust port opened and closed by the exhaust valve 10, and is connected at the other end thereof to an exhaust manifold 41. An $O_2$ sensor 40 is mounted on the exhaust manifold 41.

As shown in FIG. 1, a throttle body 23 is connected to the intake manifold 21 through a surge tank 20, and an intake pipe 25 extends from the throttle body 23. The intake pipe 25 has its extreme end connected to an air cleaner 22. The air cleaner 22 contains an air filter 63, an airflow sensor 64 for detecting the quantity of intake air, and an intake air temperature sensor 65 for detecting the temperature of intake air. The throttle body 23 has a valve passage connecting the surge tank 20 and the intake pipe 25, and a butterfly type throttle valve 28 is arranged in the valve passage. The throttle valve 28 is capable of opening the valve passage in accordance with a depression of an accelerator pedal (not shown). A branch passage bypassing the throttle valve 28 is also formed in the throttle body 23 separately from the valve passage, and a first air bypass valve 24 is arranged in the branch passage. The first air bypass valve 24 is actuated by a stepping motor (not shown). Further, in the throttle body 23 are arranged a throttle sensor 29 for detecting the opening of the throttle valve 28, that is, a throttle opening $\theta_{TH}$, and an idle switch 30 for detecting the completely closed state of the throttle valve 28.

A bypass pipe 26 branches off from the intake pipe 25 at a location more upstream than the throttle body 23, and communicates with a downstream-side end portion of the valve passage of the throttle body 23. The bypass pipe 26 has a flow sectional area nearly equal to that of the intake pipe 25, and a second air bypass valve 27 is inserted in the middle of the bypass pipe 26. The second air bypass valve 27 comprises a linear solenoid valve.

An exhaust pipe 43 extends from the exhaust manifold 41 and has its extreme end connected to a muffler (not shown). An exhaust gas purifying device 42 containing a three-way catalyst is inserted in the middle of the exhaust pipe 43.

In the cylinder head 2, EGR passages 15 branch off from a pair of exhaust passages 14 of each cylinder. The EGR passages 15 are connected via a manifold (not shown) to one end of an EGR pipe 44, the other end of which is connected to an upstream-side end portion of the surge tank 20. An EGR valve 45 is inserted in the middle of the EGR pipe 44 and is driven by a stepping motor (not shown).

The engine system is also provided with a fuel tank 50, which is arranged at the rear part of a vehicle body, not shown. An electric low-pressure pump 51 is mounted on the fuel tank 50 and is connected to a high-pressure pump 55 through a low-pressure pipe 52. A return pipe 53 branches off from the low-pressure pipe 52 and is connected to the fuel tank 50. When the low-pressure pump 51 is driven, therefore, it draws fuel from the fuel tank 50 and feeds it toward the high-pressure pump 55. A low-pressure regulator 54 is inserted in the return pipe 53 and is capable of adjusting the pressure of fuel supplied from the low-pressure pump 51 to the high-pressure pump 55, that is, the fuel pressure in the low-pressure pipe 52, to a fixed low-pressure value (e.g., 3.35 kg/mm$^2$).

The high-pressure pump 55 comprises a swash-plate type axial piston pump whose piston shaft is coupled to the exhaust camshaft 12. A high-pressure pipe 56 extends from the high-pressure pump 55 and is connected to a distribution pipe 57. Four delivery pipes 62 branch off from the distribution pipe 57 and are connected to the corresponding fuel injectors 4. When the high-pressure pump 55 is driven by rotation of the engine 1, that is, rotation of the exhaust side camshaft 12, the pump 55 draws fuel from the fuel tank 50 through the low-pressure pump 51 and the low-pressure pipe 52 and supplies the fuel to the individual fuel injectors 4 through the high-pressure pipe 56, the distribution pipe 57 and the delivery pipes 62. The high-pressure pump 55 has a capability to discharge fuel at a high pressure of 50 kg/mm$^2$ or above even when the engine 1 is idling, and the discharge pressure of fuel from the high-pressure pump 55 rises with increase in the rotational speed of the engine 1. A return pipe 58 extends from the distribution pipe 57 and is connected to a portion of the return pipe 53 between the fuel tank 50 and the low-pressure regulator 54. A high-pressure regulator 59 is inserted in the return pipe 58 and is capable of adjusting the pressure of fuel supplied from the high-pressure pump 55 to the individual fuel injectors 4, that is, the fuel pressure in a fuel passage including the high-pressure pipe 56, the distribution pipe 57 and the delivery pipes 62, to a high-pressure value of about 50 kg/mm$^2$. The high-pressure regulator 59 is associated with an electromagnetic fuel-pressure switching valve 60, which can open and close a bypass passage (not shown) in the high-pressure regulator 59. When the fuel-pressure switching valve 60 is switched on, the bypass passage in the high-pressure regulator 59 is opened; consequently, increase of the fuel pressure in the aforementioned fuel passage is restricted to a predetermined value, for example, to the low-pressure value (3.35 kg/mm$^2$) mentioned above.

As shown in FIG. 1, a return pipe 61 extends from the high-pressure pump 55 and is connected to a portion of the return pipe 53 between the fuel tank 50 and the low-pressure regulator 54. Part of the fuel supplied to the high-pressure pump 55 is used to lubricate and cool the pump 55, and then is returned to the fuel tank 50 through the return pipes 61 and 53.

The aforementioned various electric sensors, switches and devices are connected electrically to an electronic control unit (ECU) 70. The ECU 70 is supplied with signals from the sensors and switches, and controls the operation of the individual devices in accordance with the signals. As shown in FIG. 1, an oil temperature sensor 67, which detects the temperature of lubricating oil in a manual transmission 66, is also electrically connected to the ECU 70.

Figure 3:
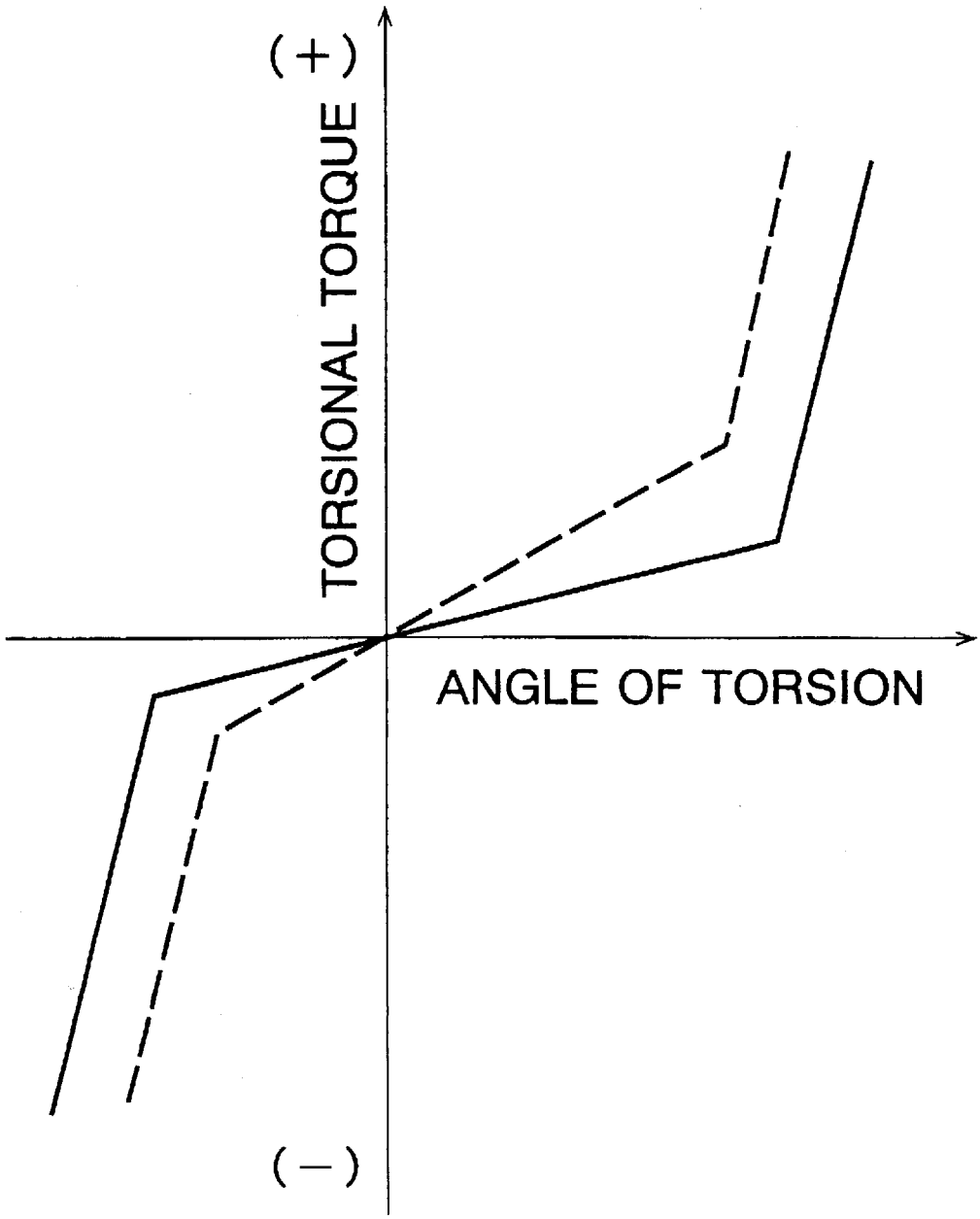
FIG. 3 is a graph showing a characteristic of a torsion spring in a clutch.

The manual transmission 66 can be coupled to the engine 1 through a clutch 71, which includes clutch discs (not shown) with a torsion spring serving as a rotational direction absorbing mechanism. The torsion spring of the clutch discs has a two-stage torsion characteristic, as indicated by the solid line in FIG. 3. The broken line in FIG. 3 indicates a two-stage torsion characteristic of a clutch used in an ordinary type gasoline engine, that is, the torsion characteristic of a torsion spring of clutch discs used in such a clutch. The ordinary type gasoline engine mentioned herein represents an engine in which fuel is injected to the intake passage, unlike the cylinder-injection type engine 1 of this embodiment. Since in the cylinder-injection type engine 1, latter-stage injection is effected during idling operation (see FIG. 5), fluctuation of the rotational speed of the engine 1 during idling is liable to increase, compared with the ordinary engine. Therefore, in order to prevent such fluctuation of the rotational speed of the engine 1 from being transmitted to the manual transmission 66, the torsion spring of the clutch 71 has a characteristic such that the torsional torque, that is, the spring constant thereof, is small in a small rotational angle region of the clutch discs, compared with the torsion spring of the ordinary clutch, as seen from FIG. 3.

Figure 4:
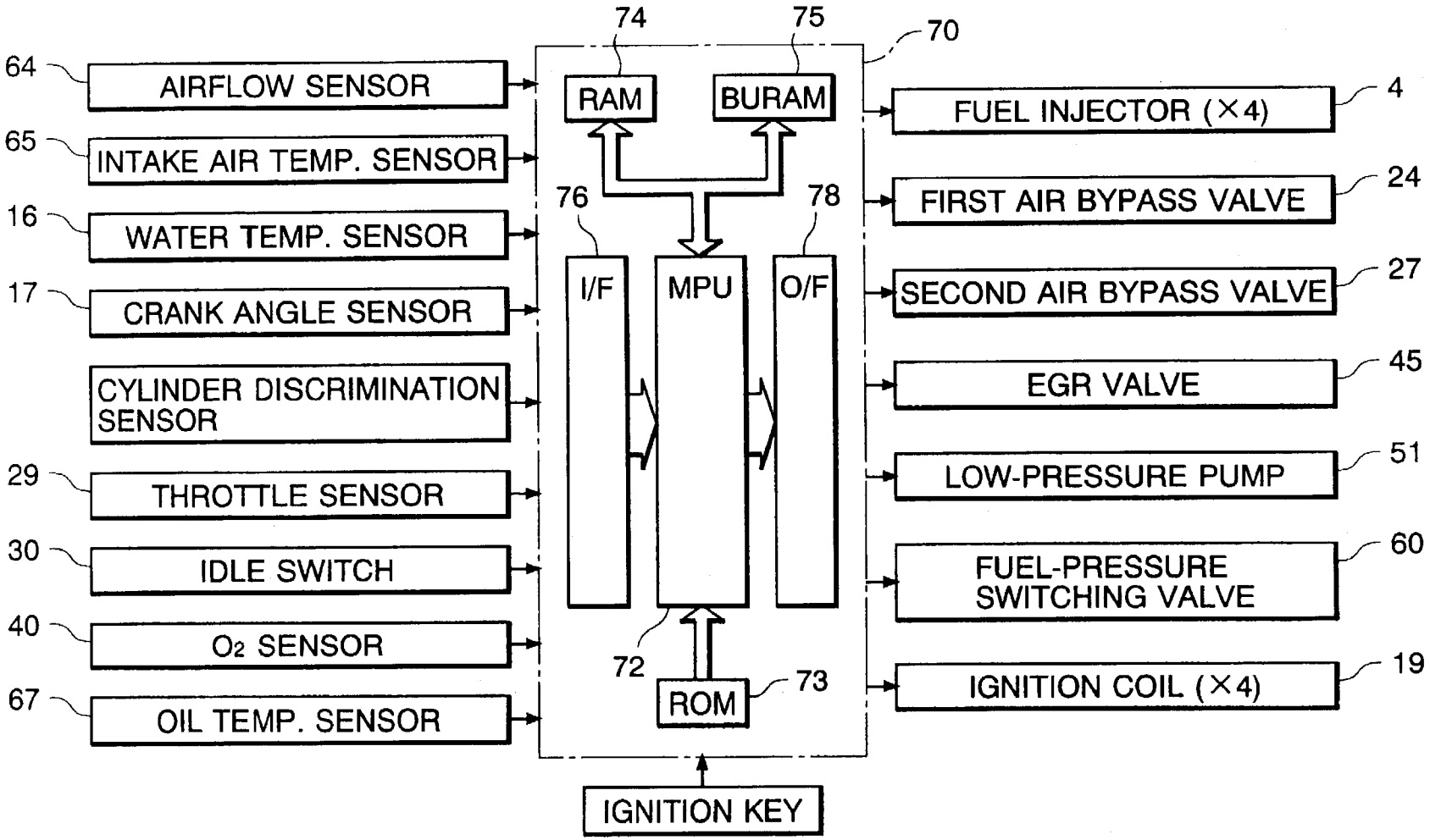
FIG. 4 is a block diagram collectively showing various sensors, switches, and control devices connected to an ECU.

Referring to FIG. 4, there are collectively shown the sensors, switches and devices electrically connected to the ECU 70. The ECU 70 is a so-called microcomputer and includes basic circuits such as a microprocessor (MPU) 72, a read-only memory 73 (ROM), a random-access memory 74 (RAM), a backup memory 75 (BURAM), an input interface 72, an output interface 76, etc. To the input interface 72 are electrically connected the aforementioned water temperature sensor 16, crank angle sensors 17, throttle sensor 29, idle switch 30, $O_2$ sensor 40, airflow sensor 64, intake air temperature sensor 65, oil temperature sensor 67, negative pressure switch 69, cylinder discrimination sensor, as well as the ignition key and the like. To the output interface 78 are electrically connected the aforementioned fuel injectors 4, first air bypass valve 24, second air bypass valve 27, EGR valve 45, low-pressure pump 51, fuel-pressure switching valve 60, ignition coils 19, as well as various warning lamps (not shown) and the like.

The ROM 73 in the ECU 70 stores in advance a control program for controlling the operation of the engine system described above, and control maps used during execution of the control program. On receiving input signals from the sensors and switches via the input interface 76, the ECU 70 determines a fuel injection control mode including air-fuel ratio control, in accordance with these input signals, the control program and the control maps, and then outputs via the output interface 78 control signals to devices such as the fuel injectors 4, ignition coils 19, EGR valve 45, low-pressure pump 51 and fuel-pressure switching valve 60, to thereby control the fuel injection timing, fuel injection quantity, ignition timing, the quantity of exhaust gas to be returned to the intake side, etc.

The fuel injection control modes include a former-stage injection control mode in which fuel is injected during the suction stroke of the engine 1 and a latter-stage injection control mode in which fuel is injected during the compression stroke of the engine 1. Also, the air-fuel ratio control in the latter-stage injection control mode includes lean control in which the average air-fuel ratio in the cylinders is controlled to an air-fuel ratio (20 to 40) greater than the stoichiometric air-fuel ratio, and cold-state/low-load control which is executed when the engine 1 is in a cold, low-load state and in which the average air-fuel ratio in the cylinders is controlled to a value in the vicinity of the stoichiometric air-fuel ratio. The air-fuel ratio control in the former-stage injection control mode includes lean control in which the air-fuel ratio in the cylinders is controlled to an air-fuel ratio (20 to 25 or thereabouts) greater than the stoichiometric air-fuel ratio, stoichiometric feedback control in which the average air-fuel ratio is controlled to the stoichiometric air-fuel ratio, and open-loop control in which the average air-fuel ratio is controlled to a required air-fuel ratio smaller than the stoichiometric air-fuel ratio.

An outline of the engine control executed by the ECU 70 will be now explained.

Outline of Engine Control

During Engine Cranking

When the ignition key of the engine 1 is turned on by the driver, the ECU 70 switches on the fuel-pressure switching valve 60 and at the same time drives the low-pressure pump 51, then closes the air bypass valve 27. Switching on the fuel-pressure switching valve 60 opens the bypass passage inside the high-pressure regulator 59, and therefore, the pressure in the fuel passage extending from the high-pressure pump 55 to the delivery pipes 62 for the respective fuel injectors 4 is decreased to the aforementioned low-pressure value. Since the pressure of fuel discharged from the low-pressure pump 51 toward the high-pressure pump 55 also is adjusted to a low-pressure value by the low-pressure regulator 54, the fuel pressure in the fuel supply passage extending from the low-pressure pump 51 to the fuel injectors 4 via the high-pressure pump 55 is kept at the low-pressure value.

When the ignition key is turned to the start position thereafter by the driver, the engine 1 is cranked by a self-starting motor (not shown) and at the same time the ECU 70 initiates the fuel injection control. In this case, the quantity of fuel injected from the fuel injectors 4 directly into the corresponding cylinders is determined based on the pressure in the fuel supply passage, the valve open time of the fuel injectors 4, and the quantity of intake air supplied to the cylinders. While the engine 1 is cranking, the quantity of intake air supplied to the individual cylinders is determined by the quantity of air flowing through the gap between the valve passage of the throttle body 23 and the throttle valve 28 and by the quantity of air flowing through the branch passage inside the throttle body 23 via the first air bypass valve 24. The opening of the first air bypass valve 24 also is controlled by the ECU 70.

Cranking of the engine 1 drives the high-pressure pump 55, whereby the high-pressure pump 55 raises the pressure of fuel supplied thereto from the low-pressure pump 51 side and discharges pressurized fuel to the fuel injector 4 side. During cranking of the engine 1, however, the pressure of fuel discharged from the high-pressure pump 55 is unstable, and therefore, the discharge pressure of the high-pressure pump 55 cannot be used for the fuel injection control. Accordingly, during cranking of the engine 1, low-pressure fuel obtained by adjusting the pressure of fuel discharged from the low-pressure pump 51 is used for the purpose.

At Engine Start

When the engine 1 is being started, the ECU 70 selects the former-stage injection control mode for the injection control mode, and in this former-stage injection control mode, the aforementioned open-loop control is employed. In such a situation, therefore, fuel is injected directly into each cylinder during the suction stroke, and the fuel injection quantity is controlled so that the average air-fuel ratio in each cylinder may be small relative to the stoichiometric air-fuel ratio. Namely, the mixture of air and fuel supplied to the cylinders is relatively rich. Consequently, even if the rate of fuel vaporization within the cylinders is low at the start of the engine 1, fuel injected during the suction stroke can be fully vaporized by the time the expansion stroke takes place. Further, since the mixture in the cylinders is relatively rich, the fuel ignites during the expansion stroke without fail and burns satisfactorily. As a result, the generation of unburned fuel (hydrocarbons (HC)) attributable to misfire of the cylinders can be suppressed.

In the cylinder-injection type engine 1, injected fuel never adheres to the inner wall surface of the intake passage 13, unlike the ordinary type engine, and thus the response and precision of the fuel injection quantity control can be improved with ease.

Idling After Cold Start (During Warm-up)

When cranking of the engine 1 is completed and the operating state of the engine 1 changes to idling, that is, when the ignition key is returned from the start position to the on position, the ECU 70 switches off the fuel-pressure switching valve 60. In this case, the openings of the first and second air bypass valves 24 and 27 are held at their idle opening. Also, the engine 1 drives the high-pressure pump 55 stably so that the fuel pressure in the fuel passage extending from the high-pressure pump 55 to the fuel injectors 4 rises, and this fuel pressure is kept at the aforementioned high-pressure value by the action of the high-pressure regulator 59. As a consequence, the high-pressure pump 55 discharges high-pressure fuel toward the fuel injectors 4.

During idling operation before completion of the warm-up of the engine 1, that is, before the cooling water temperature $T_{WT}$ of the engine 1 reaches a predetermined value (e.g., 50° C.), the ECU 70 selects the former-stage injection control mode for the injection control mode, as in the case of cold start; however, the quantity of fuel injected to the individual cylinders at this time is determined by the high fuel pressure in the aforementioned fuel passage and the valve open time of the fuel injectors 4.

When the operation of auxiliary machinery of the vehicle, for example, an air conditioner (not shown), is switched on or off and thus the load on the engine 1 increases or decreases, the ECU 70 controls the opening of the first air bypass valve 24, that is, the intake air quantity and fuel injection quantity for the individual cylinders, thereby to keep the idling speed of the engine 1 constant.

Also, when the temperature of the $O_2$ sensor 40 rises up to the activation temperature during warm-up operation, the ECU 70 switches the air-fuel ratio control in the former-stage injection control mode to the stoichiometric feedback control, whereby the fuel injection quantity is controlled based on the output signal from the $O_2$ sensor 40 so that the average air-fuel ratio in the cylinders may become equal to the stoichiometric air-fuel ratio. Consequently, the three-way catalyst of the exhaust gas purifying device 42 can effectively purify harmful components in the exhaust gas.

After Completion of Engine Warm-Up

Figure 5:
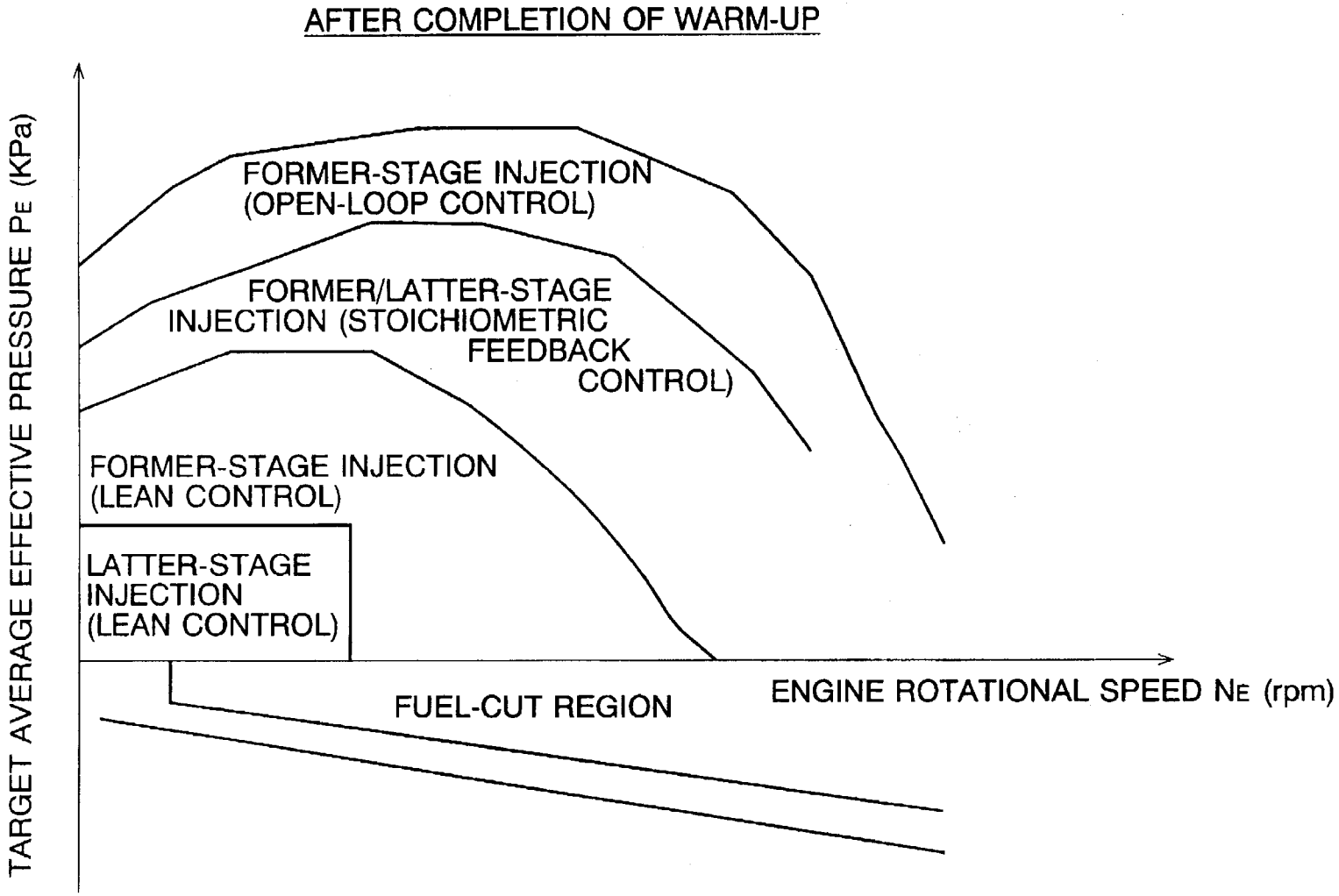
FIG. 5 is a graph showing fuel injection control modes bounded according to operating states of the engine after completion of warm-up.

Upon completion of the warm-up of the engine 1, the ECU 70 determines an injection control mode including the air-fuel ratio control and the fuel injection timing control, based on the engine rotational speed $N_E$ and a target average effective pressure $P_E$ as engine load-related information with the use of a control map shown in FIG. 5, and controls the opening/closing of the second air bypass valve 27 and the EGR valve 45 in accordance with the determined injection control mode. In this embodiment, the ECU 70 calculates the target average effective pressure $P_E$ for the engine 1 on the basis of the throttle opening $\theta_{TH}$ output from the throttle sensor 29, the engine rotational speed $N_E$, etc., and calculates the engine rotational speed $N_E$ on the basis of the crank angle signals output from the crank angle sensors 17.

The following is a description of the injection control modes selectively applied in accordance with a steady operating state of the engine 1.

During Idling (Low-load/low-speed) Operation of Engine

When the engine 1 is idling (at low load and at low rotational speed), that is, when both the engine rotational speed $N_E$ and the target average effective pressure $P_E$ are low, the ECU 70 switches the fuel injection control mode to the latter-stage injection control mode (lean control), as can be seen from the control map of FIG. 5. At this time, the ECU 70 fully opens the second air bypass valve 27 and the EGR valve 45. Since the second air bypass valve 27 is opened, intake air is introduced into the surge tank 20 via the bypass pipe 26, regardless of the opening of the throttle valve 28, thus permitting a large quantity of intake air to be supplied to the individual cylinders. Also, since the EGR valve 45 is opened, part of the exhaust gas is introduced into the surge tank 20. Accordingly, intake air containing exhaust gas is supplied to the individual cylinders. In this case, the rate of exhaust gas supplied to each cylinder is set to 30 to 60% of the intake air quantity. Also, the quantity of fuel injected from the fuel injectors 4 is controlled so that the average air-fuel ratio in the cylinders may take a value of 20 to 40 or thereabouts.

Figure 6:
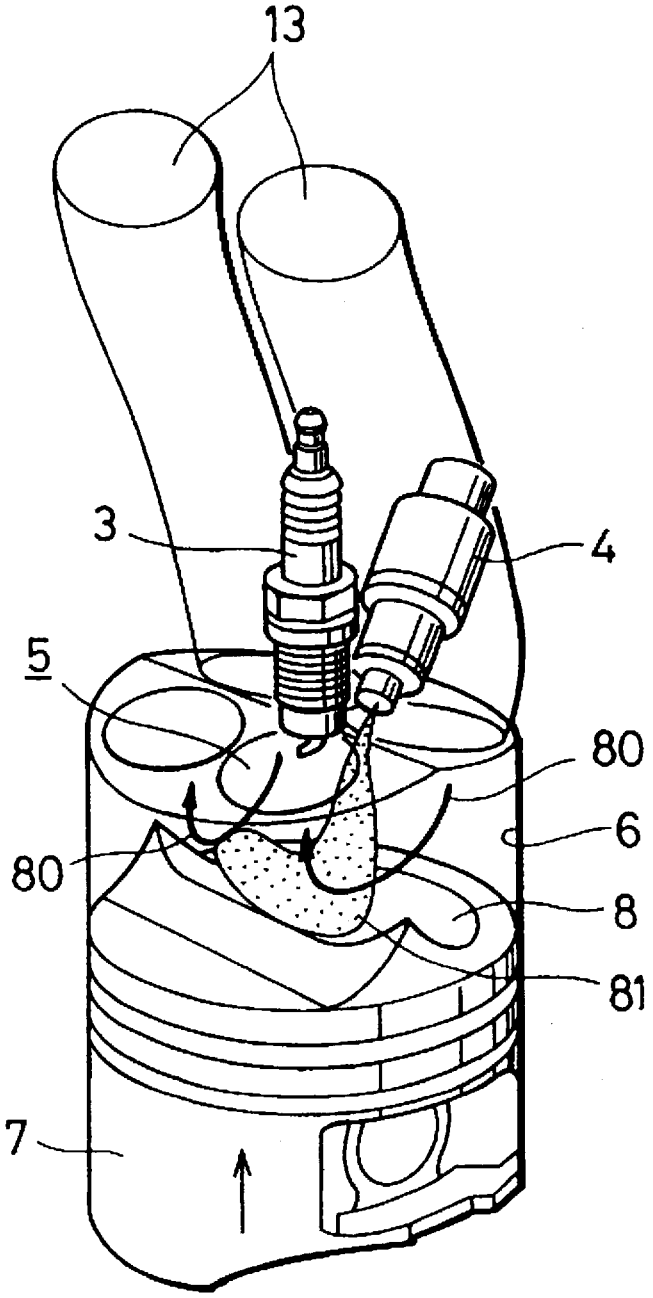
FIG. 6 is a view showing fuel injection during a compression stroke.

Thus, the average air-fuel ratio is large, but since the injection control mode has been switched to the latter-stage injection mode, fuel injected from each fuel injector 4 into the corresponding cylinder during the compression stroke forms a mixture having an air-fuel ratio close to the stoichiometric air-fuel ratio in the vicinity of the spark plug 3 immediately before the ignition time. More specifically, the semispherical cavity 8 is formed in the top face of each piston 7 as mentioned above, and therefore, the rising motion of the piston 7 during the compression stroke creates a reverse tumble flow of intake air within the cylinder, as indicated by arrows 80 in FIG. 6. In addition, each fuel injector 4 injects fuel toward the cavity 8 of the corresponding piston 7. Accordingly, most part of atomized fuel remains in the cavity 8, that is, in the vicinity of the spark plug 3; therefore, even if the average air-fuel ratio in the cylinder is large, it is possible to form a mixture having an air-fuel ratio close to the stoichiometric air-fuel ratio in the vicinity of the spark plug 3, permitting the atomized fuel to be ignited by the spark plug 3 with reliability. As a result, lean-burn operation of the engine 1 is available, and CO and HC in the exhaust gas as well as the fuel consumption can be cut down. In this case, moreover, since the intake air supplied to the cylinders contains a large quantity of exhaust gas, nitrogen oxides ($NO_x$) in the exhaust gas can be greatly lessened.

When the latter-stage injection control mode is selected as the fuel injection control mode, intake air bypassing the throttle valve 23 is introduced to the individual cylinders, and therefore, the throttling loss of the valve passage due to presence of the throttle valve 23 and the pumping loss can be reduced.

While the engine 1 is idling, the quantity of fuel injected to each cylinder is of course increased or decreased in accordance with an increase or decrease of the engine load. Consequently, the idling speed of the engine 1 is controlled to a fixed speed, and the response of the control is greatly improved.

During Low/medium-speed Travel of Vehicle

Using the control map of FIG. 5, the ECU 70 determines based on the target average effective pressure $P_E$ and the engine rotational speed $N_E$ a control region from among the former-stage injection control mode (lean control), the former/latter-stage injection control mode (stoichiometric feedback control) and the former-stage injection control mode (open-loop control). More specifically, in the former-stage injection control mode (lean control), the ECU 70 causes fuel to be injected during the suction stroke and controls the fuel injection quantity so that the average air-fuel ratio in the cylinders may be 20 to 23 or thereabouts. In this case, the ECU 70 also controls the openings of the first and second air bypass valves 24 and 27 and the EGR valve 45.

During Rapid Acceleration or High-speed Travel

During rapid acceleration or high-speed travel of the vehicle, either the target average effective pressure $P_E$ or the engine rotational speed $N_E$ is high, and the ECU 70 switches the injection control mode to the former-stage injection control mode (open-loop control). In this case, fuel is injected during the suction stroke and the fuel injection quantity is subjected to the open-loop control so that the average air-fuel ratio in the cylinders may be small relative to the stoichiometric air-fuel ratio.

Also in the former-stage injection control mode (open-loop control), the ECU 70 controls the openings of the first and second air bypass valves 24 and 27 and the EGR valve 45.

Fuel-cut Region

On release of the accelerator pedal during medium/high-speed travel of the vehicle, the vehicle starts to slow down, and at this time, the ECU 70 stops the injection of fuel to the cylinders (fuel-cut). Accordingly, both the fuel consumption and harmful components in the exhaust gas can be cut down. If the engine rotational speed $N_E$ becomes lower than a recovery rotational speed or the accelerator pedal is again depressed, the ECU 70 immediately terminates the fuel-cut and selects one of the aforementioned control regions.

Figure 7:
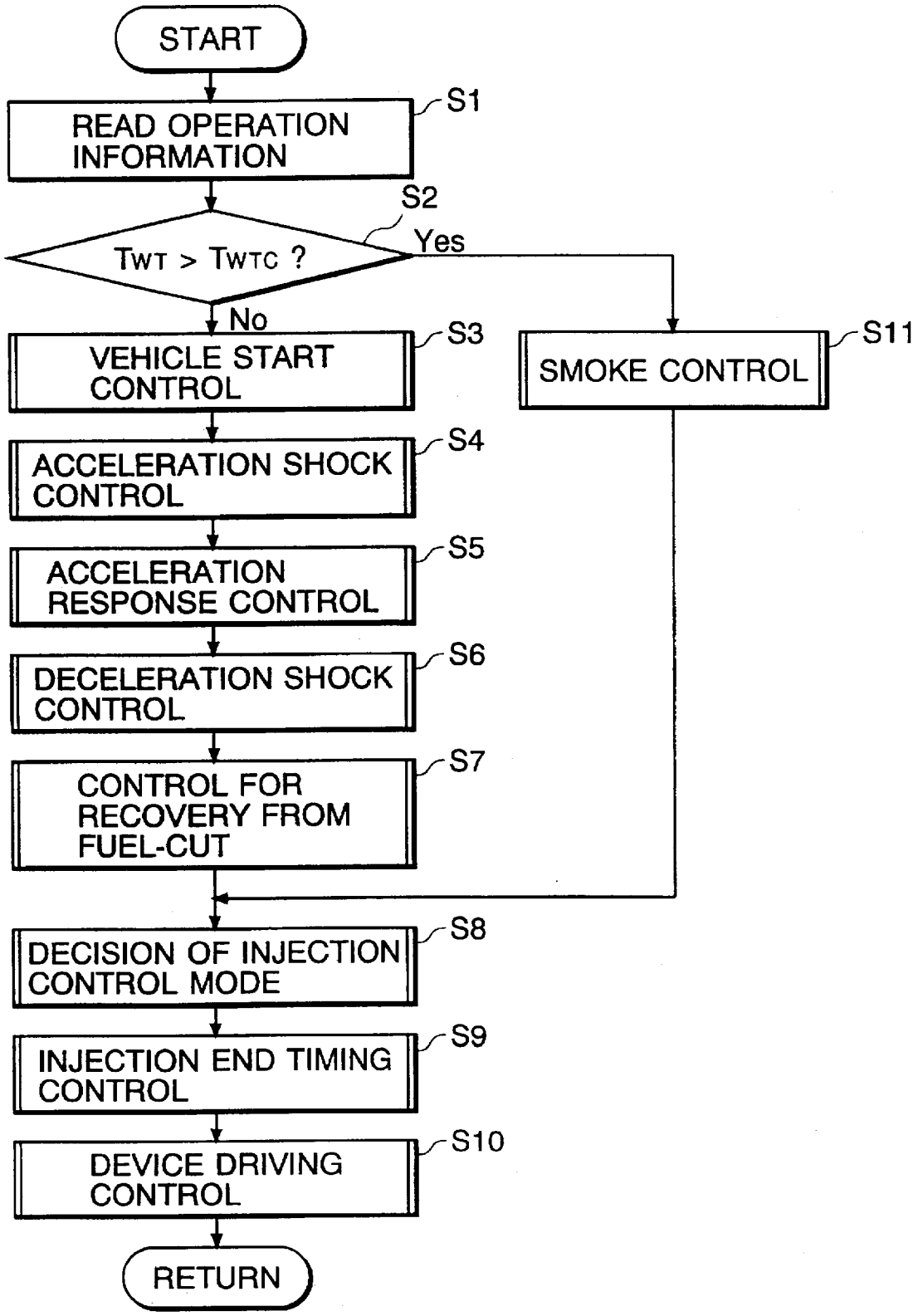
FIG. 7 is a flowchart showing a main routine for fuel injection control during a transitional operating state of the engine.

The following is a description of the procedure for selecting a fuel injection control mode during a transitional operating state of the engine 1. Specifically, when the engine 1 is operating in a transitional state, a fuel injection control mode is selected in accordance with a main routine shown in FIG. 7, and this main routine is repeatedly executed at a predetermined cycle, for example, with every half rotation, or every stroke, of the engine 1.

Main Routine

In Step S1, the ECU 70 reads operation information of the engine system based on the output signals from the aforementioned various sensors and switches. More specifically, the ECU 70 obtains the cooling water temperature $T_{WT}$, throttle opening $\theta_{TH}$, intake air temperature $T_{AIR}$, oil temperature $T_{TM}$ of the manual transmission 66, and engine rotational speed $N_E$ based on the output signals from the various sensors. Also, based on the read information, the ECU 70 calculates the target average effective pressure $P_E$, throttle opening velocity $\Delta\theta_{TH}$ (differential of the throttle opening), vehicle speed V, etc. as engine load information. Prior to executing Step S1, the ECU 70 performs an initialization process to set a negative value for each of various flags and decremental timers, mentioned later.

Then, in Step S2, the ECU 70 determines whether or not the cooling water temperature $T_{WT}$ of the engine 1 is lower than a predetermined temperature $T_{WTC}$ (e.g., 50° C.). If the decision in Step S2 is negative (No), that is, when the warm-up of the engine 1 is completed, the ECU 70 successively executes a vehicle start control routine, an acceleration shock control routine, an acceleration response control routine, a deceleration shock control routine, a control routine for recovery from fuel-cut, an injection control mode decision routine, and an injection ending time control routine in Steps S3 through S9, respectively, as described later, and then executes a driving control routine for devices to be controlled, in Step S10. In the driving control routine, the operations of various devices such as the fuel injectors 4, the first and second air bypass valves 24 and 27, the EGR valve 45, the ignition coils 19, etc. are controlled in accordance with control information obtained in the preceding steps.

On the other hand, if the decision in Step S2 is affirmative (Yes), that is, when the warm-up of the engine 1 is not yet completed, the ECU 70 successively executes Step S11, Step S8 and the following steps.

Details of the individual steps will be now explained in order.

Vehicle Start Control Routine

Figure 8:
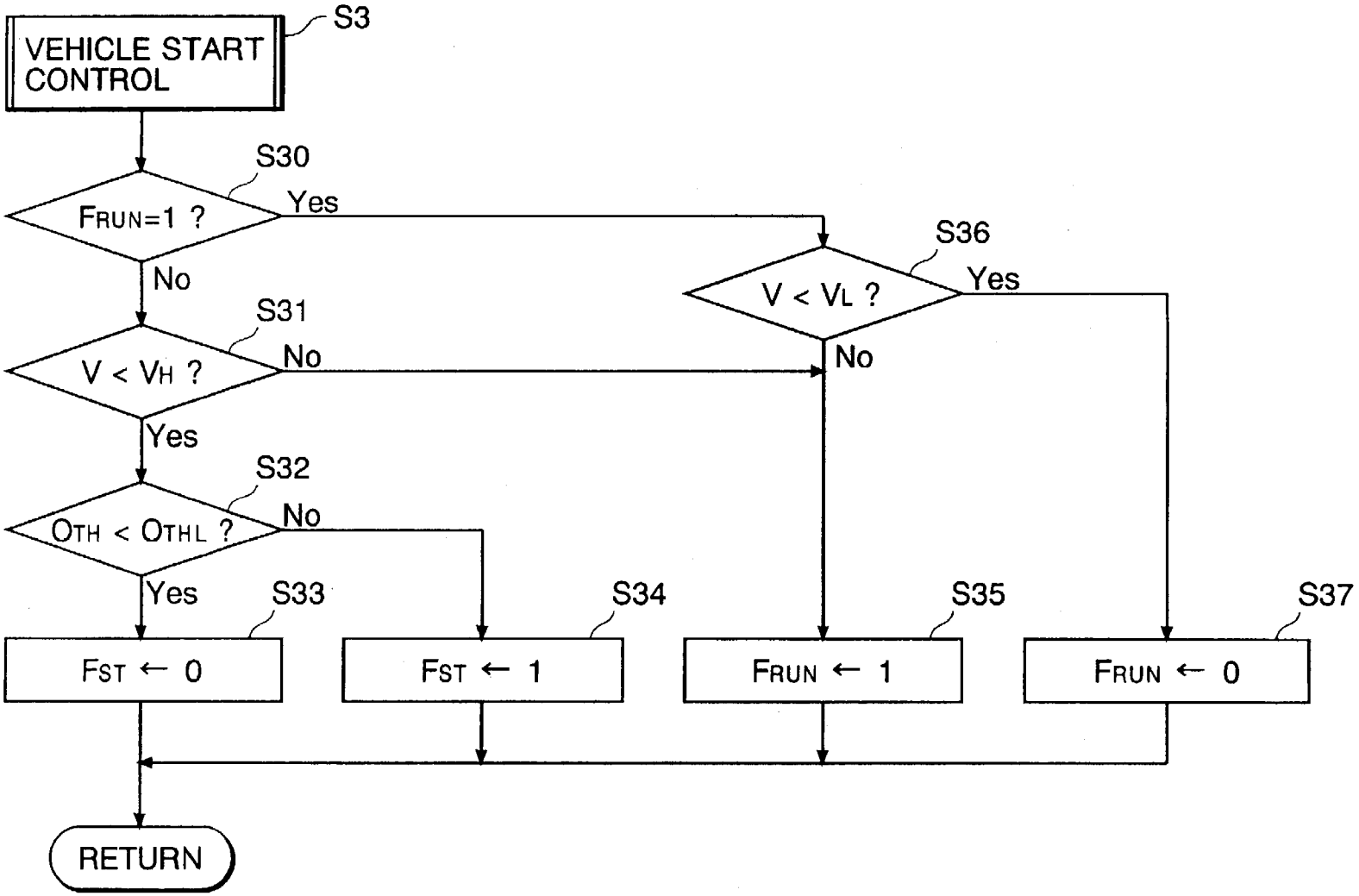
FIG. 8 is a flowchart showing details of a vehicle start control routine.

In the vehicle start control routine (Step S3) shown in FIG. 8, first, in Step S30, it is determined whether or not "1" has been set for a run flag $F_{RUN}$. When Step S30 is executed for the first time after the start of the engine 1, a negative value has been set for the run flag $F_{RUN}$. Therefore, the decision in this step is No, and it is then determined whether or not the vehicle speed V is lower than a first vehicle speed $V_H$ (e.g., 5 km/h) (Step S31). If the decision in Step S31 is Yes, it is then determined whether or not the throttle opening $\theta_{TH}$ is smaller than a throttle threshold $\theta_{THL}$ (e.g., 5% opening) (Step S32). If the decision in this step also is Yes, it can be judged that the vehicle is standing still and also that the driver has no intention of starting the vehicle, and therefore, "0" is set for a start flag $F_{ST}$ (Step S33).

If the throttle opening $\theta_{TH}$ increases as the accelerator pedal is depressed and the decision in Step S32 becomes No, then it can be judged that the driver has the intention of starting the vehicle and that the engine 1 is in a transitional state for vehicle start. In this case, "1" is set for the start flag $F_{ST}$ in Step S34. If the vehicle is started and the vehicle speed V increases, the decision in Step S31 also becomes No, in which case "1" is set for the run flag $F_{RUN}$ (Step S35).

After "1" is set for the run flag $F_{RUN}$ following the start of the vehicle, the decision in Step S30 becomes Yes. Accordingly, Step S36 is executed subsequently to Step S30, to determine whether or not the vehicle speed V has decreased below a second vehicle speed $V_L$ (e.g., 2 km/h) lower than the first vehicle speed $V_H$. If the decision in this step is No, that is, when the vehicle start is completed and the vehicle is running, Step S35 is repeatedly executed and the value of the run flag $F_{RUN}$ is held at "1".

On the other hand, if the vehicle decelerates and is almost stopping and thus the decision in Step S36 becomes Yes, the run flag $F_{RUN}$ is set to "0" (Step S37). Namely, the run flag $F_{RUN}$ is set to "1" or "0" in accordance with the vehicle speed V. Since the second vehicle speed $V_2$ is set to a value smaller than the first vehicle speed $V_1$, the run flag $F_{RUN}$ setting never undergoes hunting when the vehicle is traveling at a very low speed.

While "1" is set for the start flag $F_{ST}$, the ECU 70 can select the former-stage injection control mode (stoichiometric feedback control) for the injection control mode, in the injection control mode decision routine described later.

On the other hand, while the start flag $F_{ST}$ is reset to "0", the ECU 70 selects an injection control mode based on the target average effective pressure $P_E$ and the engine rotational speed $N_E$ by using the map in the decision routine.

Acceleration Shock Control Routine

Figure 9:
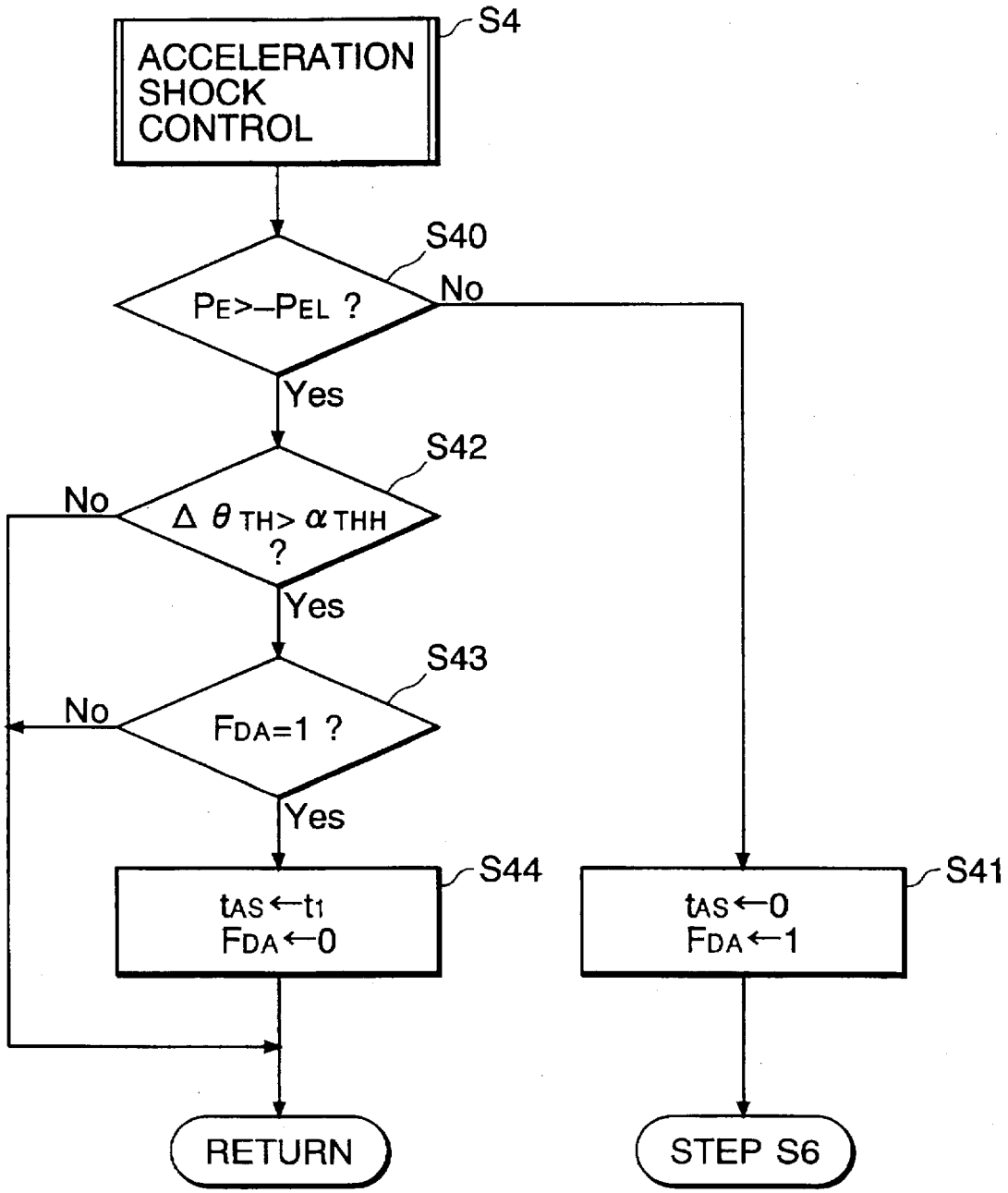
FIG. 9 is a flowchart showing details of an acceleration shock control routine.

As shown in FIG. 9, in the acceleration shock control routine, a determination is first made in Step S40 as to whether or not the target average effective pressure $P_E$ is higher than a predetermined pressure $-P_{EL}$ (e.g., −1 kgf/cm$^2$); if the decision in this step is Yes, that is, if the vehicle is decelerating, a decremental timer $t_{AS}$ is set to "0" and "1" is set for an acceleration flag $F_{DA}$, in Step S41. After execution of Step S41, the acceleration response control routine in Step S5 is skipped and the deceleration shock control routine in Step S6 is executed.

If the target average effective pressure $P_E$ increases thereafter as the accelerator pedal is depressed by the driver and the decision in Step S40 becomes Yes, it is determined whether or not the throttle opening velocity $\Delta\theta_{TH}$ is greater than an acceleration criterion value $\alpha_{THH}$ (Step S42). If the decision in this step is Yes, it is inferred that the driver has the intention of accelerating the vehicle, and a determination is then made in Step S43 as to whether or not "1" has been set for the acceleration flag $F_{DA}$. In a first transitional accelerating state of the engine 1 in which the vehicle operation changes from deceleration to acceleration, the acceleration flag $F_{DA}$ has already been set to "1", and therefore, the decision in Step S43 becomes Yes. In the next Step S44, the value of the acceleration flag $F_{DA}$ is set to "0" while a predetermined value $t_1$ (e.g., 0.1 sec) is set in the decremental timer $t_{AS}$, and from this point of time, operation of the decremental timer $t_{AS}$ is started.

During operation of the decremental timer $t_{AS}$, the ECU 70 selects the latter-stage injection control mode (lean control) for the injection control mode, as described later.

Acceleration shock to be controlled by the acceleration shock control routine includes a so-called ineffective stroke elimination shock caused at the most twisted part of the torsion spring of the clutch 71 when the torsion spring is twisted from deceleration side to acceleration side. The ineffective stroke elimination shock shows a tendency to intensify as the output of the engine 1 increases, and accordingly, in a situation where the ineffective stroke elimination shock is liable to occur, the latter-stage injection control mode (lean control) is selected for a predetermined time period.

Acceleration Response Control Routine

Figure 10:
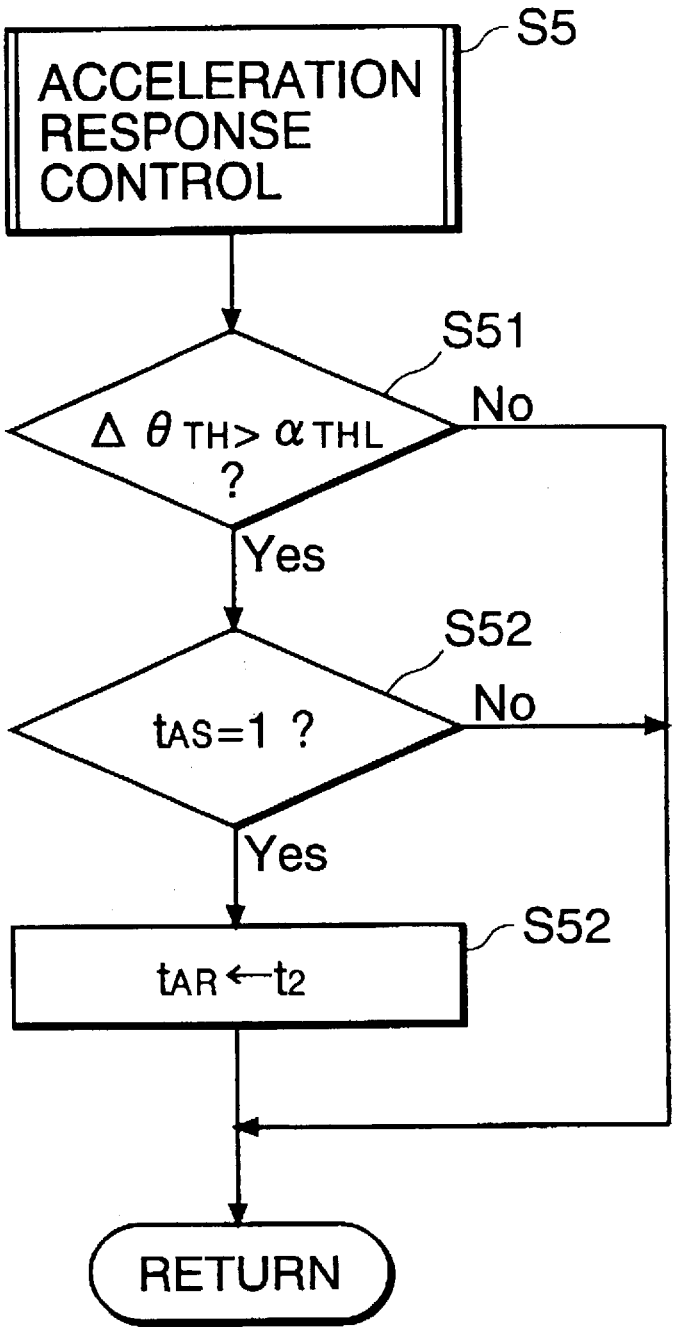
FIG. 10 is a flowchart showing details of an acceleration response control routine.

As shown in FIG. 10, in the acceleration response control routine, a determination is first made in Step S51 as to whether or not the throttle opening velocity $\Delta\theta_{TH}$ is greater than an acceleration criterion value $\alpha_{THL}$ which is smaller than the aforementioned acceleration criterion value $\alpha_{THH}$. If the decision in this step is Yes, it is determined whether or not the value of the aforementioned decremental timer $t_{AS}$ equals "0" (Step S52). If the decision in Step S52 is No, then it means that the predetermined value $t_1$ has been set in the decremental timer $t_{AS}$ in the preceding acceleration shock control routine and that the decremental timer $t_{AS}$ is in operation, and in this case, the subsequent Step S53 is skipped.

On the other hand, if the decision in Step S52 is Yes, a predetermined value $t_2$ (e.g., 1 sec) is set in a decremental timer $t_{AR}$ and operation of the decremental timer $t_{AR}$ is started. Namely, when the vehicle is operating in a state other than deceleration or in a second transitional accelerating state of the engine 1 in which the throttle opening velocity $\Delta\theta_{TH}$ becomes greater than the acceleration criterion value $\alpha_{THL}$ after the decremental timer $t_{AS}$ has stopped operating, operation of the decremental timer $t_{AR}$ is started.

During operation of the decremental timer $t_{AR}$, the ECU 70 inhibits the latter-stage injection control mode from being selected, as described later.

Deceleration Shock Control Routine

Figure 11:
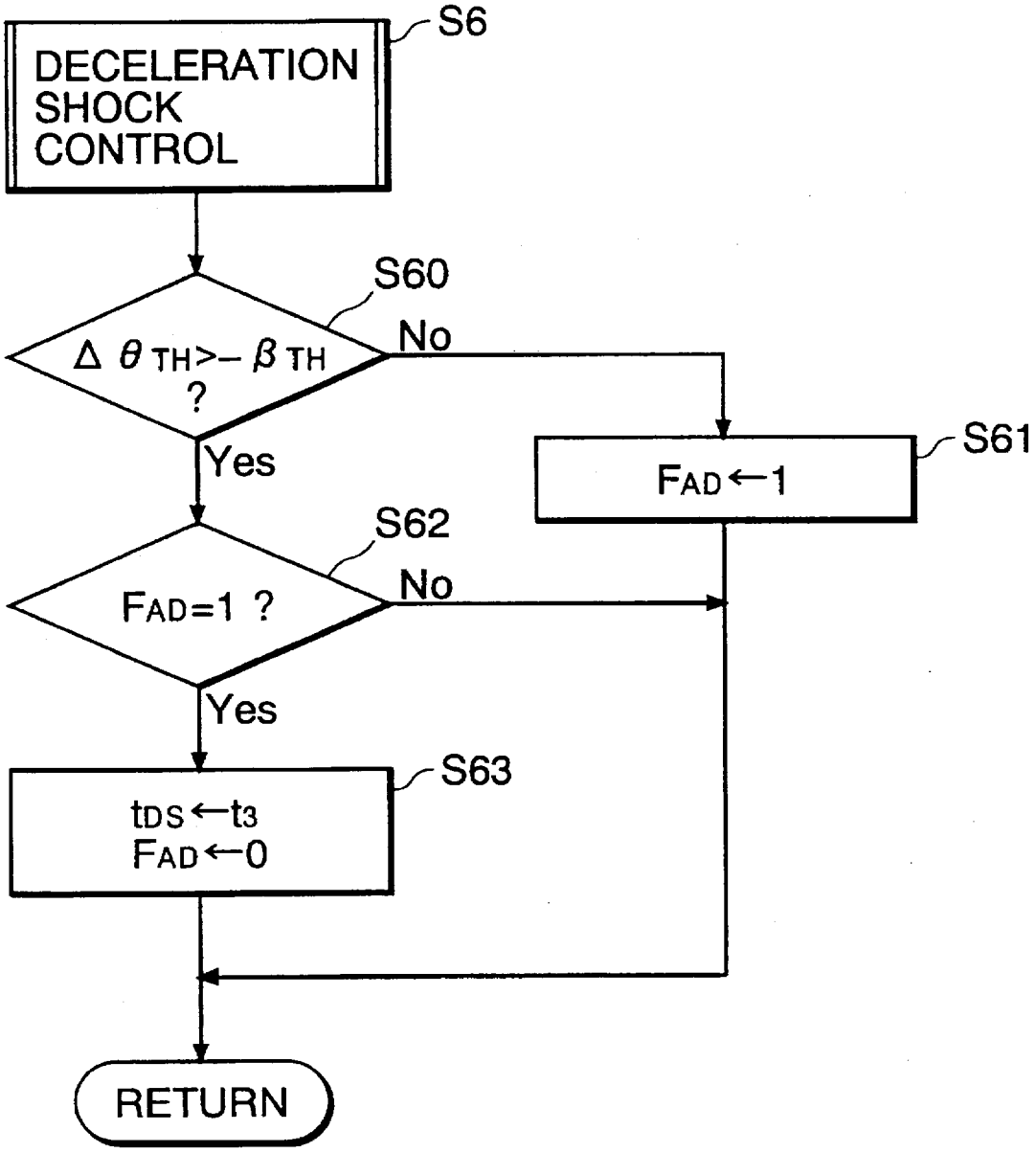
FIG. 11 is a flowchart showing details of a deceleration shock control routine.

As shown in FIG. 11, in the deceleration shock control routine, it is first determined in Step S60 whether or not the throttle opening velocity $\Delta\theta_{TH}$ is smaller than a predetermined value $-\beta_{TH}$, that is, whether or not the vehicle is going to decelerate with its accelerator pedal being returned. If the decision in this step is No, "1" is set for a deceleration flag $F_{AD}$ (Step S61). Namely, "1" is set for the deceleration flag $F_{AD}$ unless the accelerator pedal is returned at a velocity greater than the predetermined velocity.

On the other hand, if the decision in Step S60 is Yes, it is determined whether or not the value of the deceleration flag $F_{AD}$ equals "1" (Step S62). If the decision in this step is Yes, then it means that the vehicle is traveling at constant speed or that the engine 1 is in a transitional decelerating state in which the engine operation changes from acceleration to deceleration. In this case, the deceleration flag $F_{AD}$ is reset to "0" while a predetermined value $t_3$ (e.g., 0.5 sec) is set in a decremental timer $t_{DS}$ in the subsequent Step S63, and from this point of time, operation of the decremental timer $t_{DS}$ is started.

During operation of the decremental timer $t_{DS}$, the ECU 70 forcibly selects the latter-stage injection control mode (lean control) for the injection control mode, as described later.

Control Routine for Recovery From Fuel-cut

Figure 12:
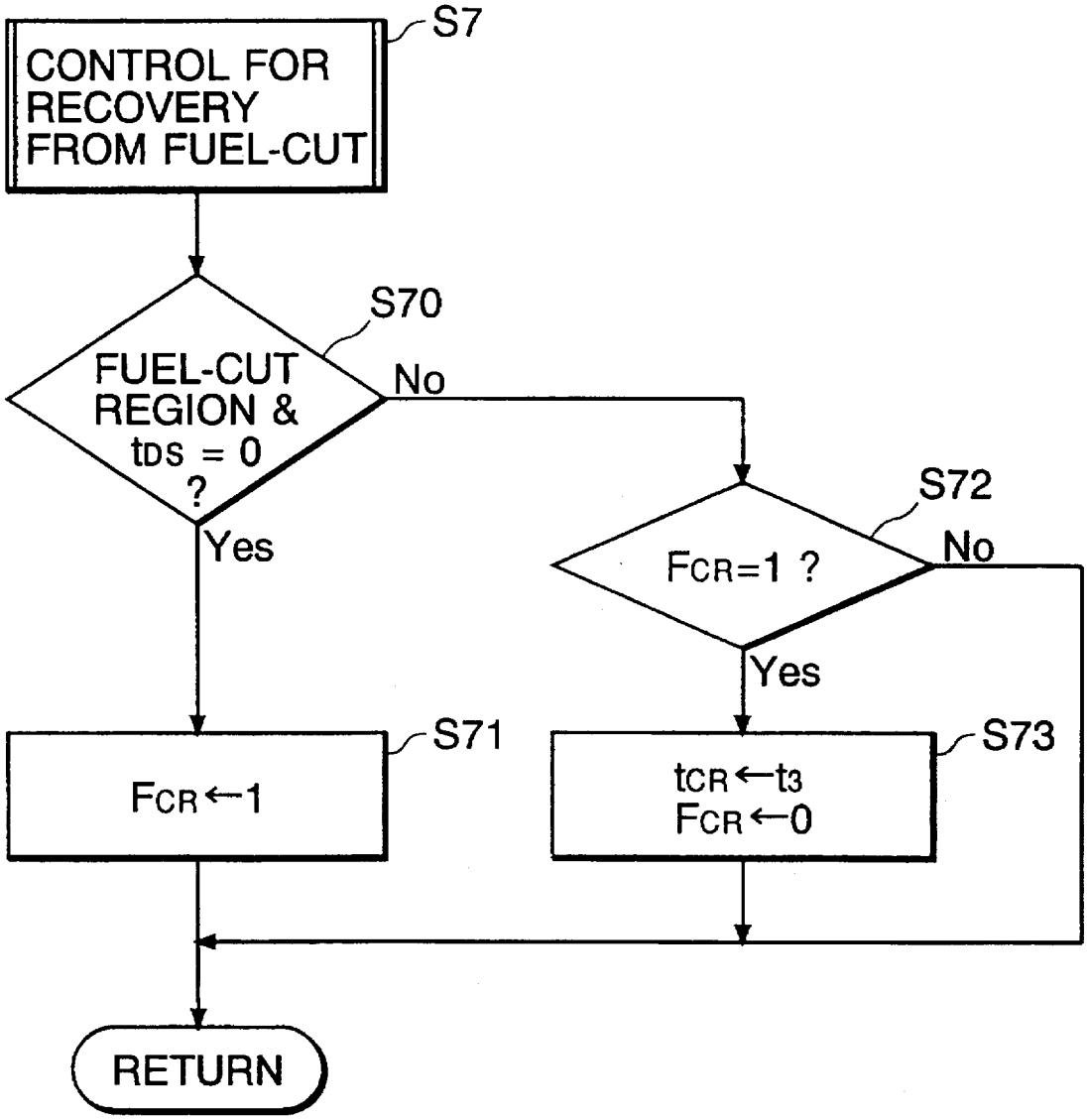
FIG. 12 is a flowchart showing details of a control routine for recovery from fuel-cut.

As shown in FIG. 12, in the routine for controlling recovery from fuel-cut, a determination is first made based on the target average effective pressure $P_E$ and the engine rotational speed $N_E$ as to whether or not the control region for the engine 1 falls under the fuel-cut region and at the same time the value of the aforementioned decremental timer $t_{DS}$ equals "0", in Step S71. If the decision in this step is Yes, that is, in a situation where the vehicle is decelerating, the operation of the decremental timer $t_{DS}$ started in the preceding deceleration shock control routine has been completed, and at the same time the control region for the engine 1 falls under the fuel-cut region, "1" is set for a recovery flag $F_{CR}$ (Step S71).

When the rotational speed $N_E$ of the engine 1 thereafter decreases to the recovery rotational speed or when the accelerator pedal is depressed by the driver so that the control region for the engine 1 becomes outside the fuel-cut region, it is determined whether or not "1" has been set for the recovery flag $F_{CR}$. If the result of this determination is affirmative, that is, if the engine 1 is in a transitional state for recovery from fuel-cut, a predetermined value $t_4$ (e.g., 0.5 sec) is set in the decremental timer $t_{CR}$ while the recovery flag $F_{CR}$ is set to "0" (Step S73).

During operation of the decremental timer $t_{CR}$, the ECU 70 forcibly selects the latter-stage injection control mode for the injection control mode, as described later. In the latter-stage injection control mode applied in this case, the air-fuel ratio is controlled based on the target average effective pressure $P_E$ and the engine rotational speed $N_E$. Thus, it is possible to prevent undershoot of rotation at the time of recovery from fuel-cut, so that the recovery rotational speed for recovery from fuel-cut can be set at a low speed, thereby improving the fuel economy and preventing-the engine 1 from stalling.

Smoke Control Routine

Figure 13:
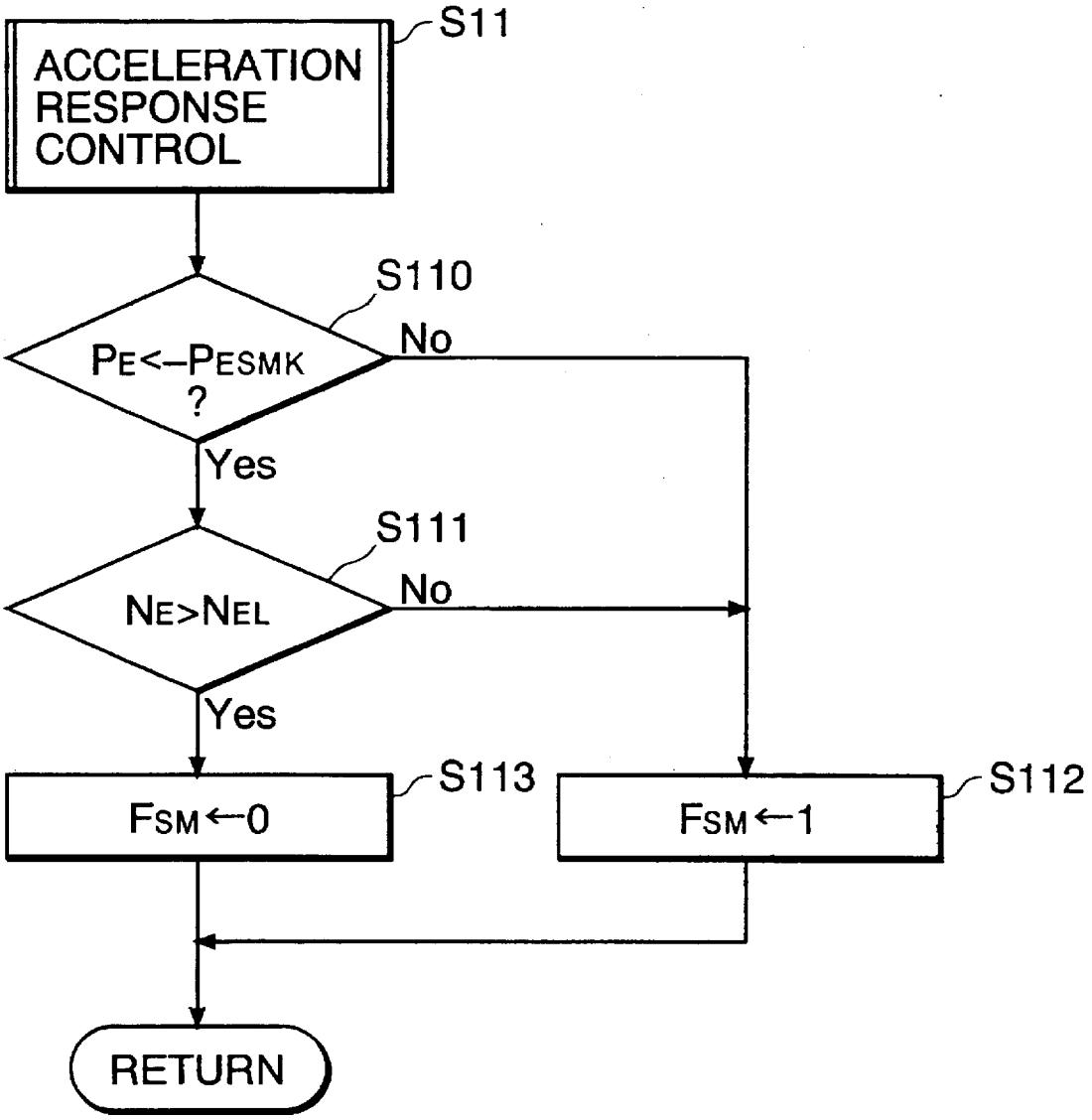
FIG. 13 is a flowchart showing details of a smoke control routine.

As shown in FIG. 13, in the smoke control routine, it is first determined in Step S110 whether or not the target average effective pressure $P_E$ is lower than a predetermined pressure $-P_{ESMK}$ (e.g., $-0.1$ kg/cm$^2$), and if the decision in this step is Yes, it is determined whether or not the engine rotational speed $N_E$ is higher than a predetermined speed $N_{EL}$ (Step S111). If the decision in either Step S110 or S111 is No, "1" is set for a smoke flag $F_{SM}$ (Step S112); on the other hand, if the decisions in Steps S110 and S111 are both Yes, that is, when intense negative pressure is produced in the cylinders during the suction stroke and at the same time the rotational speed $N_E$ of the engine 1 is relatively high, "0" is set for the smoke flag $F_{SM}$.

When "0" is set for the smoke flag $F_{SM}$, it means that the engine 1 is in a first transitional cooling state, and in this case, the ECU 70 can forcibly select the latter-stage injection control mode (e.g., cold-state/low-load control) for the injection control mode, as described later.

Injection Control Mode Decision Routine

Figure 14:
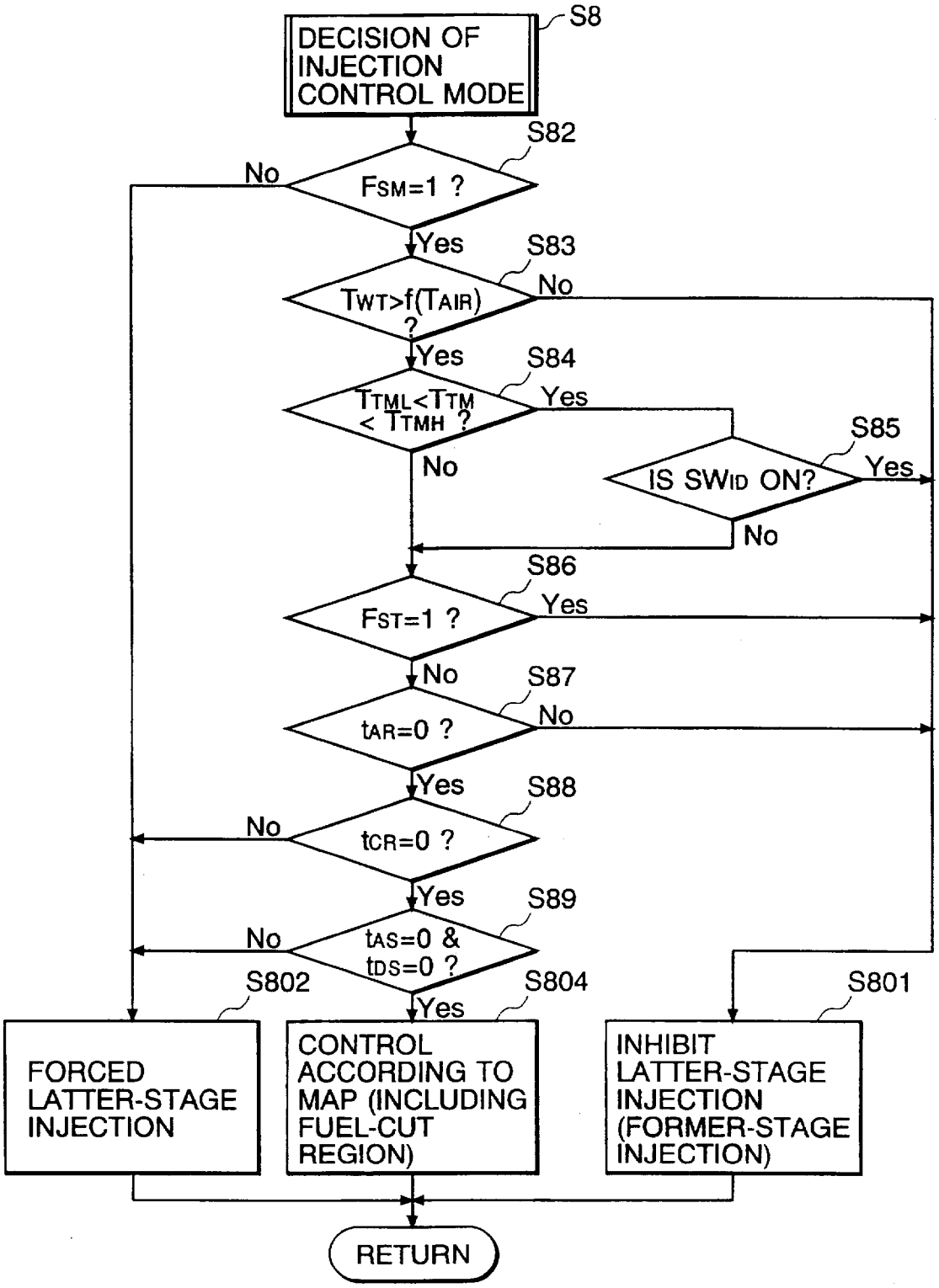
FIG. 14 is a flowchart showing details of an injection control mode decision routine.

As shown in FIG. 14, in the decision routine, a fuel injection control mode is determined in accordance with the values of the flags and decremental timers set in the aforementioned routines.

First, in Step S82, it is determined whether or not the value of the smoke flag $F_{SM}$ equals "1". If the decision in this step is No, that is, if the value of the smoke flag $F_{SM}$ is "0", the fuel injection mode is forcibly set to the latter-stage injection control mode (cold-state/low-load control), in Step S801. As is clear from the smoke control routine described above, when the value of the smoke flag $F_{SM}$ is "0", then the engine is in a situation where the target average effective pressure $P_E$, which is a load-related value, is relatively low and at the same time the engine rotational speed $N_E$ is relatively high, that is, a situation where the engine 1 is racing during warm-up, in other words, the engine 1 is operated in a deceleration region as in the subsequent drop of the rotational speed. If, in such a situation, fuel is injected according to the former-stage injection control mode, the liquid fuel in each cylinder is likely to wash the oil film off the inner wall of the cylinder, lowering the sealing performance of the piston ring. Intense negative pressure in the cylinders and deterioration in the sealing performance of the piston rings entail entry of blowby gas into the cylinders from the crankcase, increasing smoke contained in the exhaust gas and soiling the spark plugs 3, and also cause droplets of fuel to leak from the cylinders to the crankcase. On the other hand, if fuel is injected according to the latter-stage injection control mode as mentioned above, the liquid fuel burns before it washes oil off the inner walls of the cylinders, and accordingly, the aforementioned inconveniences attributable to the former-stage injection control mode are never caused.

Secondly, if the decision in Step S82 is Yes and thus the fuel injection control mode remains undecided, it is determined in the subsequent Step S83 whether or not the cooling water temperature $T_{WT}$ is higher than a predetermined temperature $f(T_{AIR})$ which is determined using the intake air temperature $T_{AIR}$ as a parameter. The predetermined temperature $f(T_{AIR})$ is set as follows, for example:

$$f(T_{AIR})=T_{WTL} \text{ (e.g., 70° C.), if } T_{AIR}>20° \text{ C.};$$

$$f(T_{AIR})=T_{WTH} \text{ (e.g., 77° C.), if } T_{AIR}<0° \text{ C.}$$

If the decision in Step S83 is No, that is, if the cooling water temperature $T_{WT}$ of the engine 1 is lower than the predetermined temperature $f(T_{AIR})$, the latter-stage injection control mode is inhibited in Step S801, so that fuel is injected according to the former-stage injection control mode (open-loop control). Namely, when the decision in Step S83 is No, then it means that the engine 1 is in a second transitional cooling state. Even in the second transitional cooling state, fuel injected during the suction stroke of the engine 1 can become sufficiently mixed with fresh air by the time the succeeding compression stroke takes place, thus ensuring satisfactory combustion of fuel. As a result, the cooling water temperature $T_{WT}$ of the engine 1 rises rapidly, whereby the automotive heating system, which utilizes the cooling water of the engine 1, can be made to operate effectively. Also, since the exhaust gas temperature rises, the $O_2$ sensor and the catalyst can be activated at an early time. Further, the time required for the warm-up operation of the engine 1 is in no way prolonged.

The predetermined temperature $f(T_{AIR})$ is set to different temperatures, that is, $T_{WTL}$ or $T_{WTH}$, in accordance with the intake air temperature $T_{AIR}$; therefore, even when the cooling water temperature $T_{WT}$ is low, Step S801 is prevented from being executed insofar as the intake air temperature $T_{AIR}$ is relatively high, making it possible to select the latter-stage injection mode (lean control) as the fuel injection control mode. In this case, although fuel is injected during the compression stroke, it can vaporize sufficiently because the intake air temperature $T_{AIR}$ is relatively high.

Thirdly, if the decision in Step S83 is Yes and thus the fuel injection control mode still remains undecided, a determination is made in the subsequent Step S84 as to whether or not the lubricating oil temperature of the manual transmission 66, that is, the oil temperature $T_{TM}$, falls within the range indicated by the expression below.

$$T_{TML} \text{ (e.g., 5° C.)}<T_{TM}<T_{TMH} \text{ (e.g., 40° C.).}$$

If the decision in this step is Yes, that is, if the oil temperature $T_{TM}$ falls within the above range and thus the manual transmission 66 is in a cold state, in other words, the viscosity of the lubricating oil of the transmission is relatively low, it is determined in Step S85 whether or not a switch signal $SW_{ID}$ from the idle switch 29 is on. If the decision in this step also is Yes, that is, when the engine 1 is idling, Step S801 is executed, whereby latter-stage injection of fuel is inhibited and fuel is injected according to the former-stage injection control mode (stoichiometric feedback control or open-loop control).

While the latter-stage injection control mode is selected as the fuel injection control mode, fluctuation of the output torque of the engine 1 is relatively large, compared with the case of the former-stage injection control mode, and such fluctuation of the output torque is largest during the idling operation of the engine 1. Therefore, the torsion spring having a two-stage torsion characteristic as mentioned above is employed for the clutch 71 coupling the engine 1 and the manual transmission 66, and the first-stage spring constant is set to a relatively small value. When the lubricating oil temperature is lower than $T_{TMH}$ during idling of the engine 1, the viscosity of the lubricating oil is so large that the angle of torsion increases beyond the first-stage spring constant of the torsion spring to an extent corresponding to the second-stage spring constant. In such a case, fluctuation of the rotational speed of the engine 1 is transmitted to the interior of the manual transmission 66 while being amplified, with the result that the manual transmission 66 makes a rattling noise. On the other hand, when the lubricating oil temperature is even lower than $T_{TML}$, the manual transmission 66 rattles therein; however, since the viscosity of the lubricating oil around the rattling part also is increased, generation of the rattling noise can be prevented by the lubricating oil itself.

In this regard, when the manual transmission 66 is in a cold state and at the same time the engine 1 is idling, the latter-stage injection control mode is inhibited from being selected as the fuel injection control mode, as mentioned above, and fuel is injected according to the former-stage injection control mode, whereby fluctuation of the output torque of the engine 1 can be lessened, making it possible to reduce the rattling noise of the manual transmission 66.

When the oil temperature $T_{TM}$ is outside the aforementioned range, especially in a situation where the oil temperature $T_{TM}$ is higher than or equal to $T_{TMH}$ and the individual parts in the manual transmission 66 are sufficiently supplied with the lubricating oil, fluctuation of the rotational speed of the engine 1 during idling is absorbed within the first-stage section of spring constant-of the torsion spring, so that no rattling noise is generated from the manual transmission 66. In such a situation, therefore, the latter-stage injection control mode can be selected as the fuel injection control mode. Although selection of the latter-stage injection control mode is permitted when the oil temperature $T_{TM}$ is lower than or equal to $T_{TML}$, it may be inhibited because the condition that the manual transmission 66 can rattle is fulfilled.

Fourthly, if the decision in either Step S84 or S85 is No and thus the fuel injection control mode still remains undecided, it is determined in Step S86 whether or not the value of the start flag $F_{ST}$ equals "1". If the decision in this step is Yes, that is, if the driver is going to start the vehicle following the idling operation of the engine 1, Step S801 is executed. Namely, latter-stage injection of fuel is inhibited at the start of the vehicle, and fuel is injected according to the former-stage injection control mode (stoichiometric feedback control or open-loop control). In this case, the air bypass valve 27 is left as it is, while the opening of the EGR valve 45 is controlled to a value determined by the control mode. Accordingly, both intake air and fuel are sufficiently supplied to the cylinders, so that the output of the engine 1 instantly increases, permitting the vehicle to start smoothly. Also, in this case, the exhaust gas from the engine 1 is effectively purified by the three-way catalyst in the exhaust gas purifying device 42.

Fifthly, if the decision in Step S86 is No and thus the fuel injection control mode still remains undecided, a determination is then made in the subsequent Step S87 as to whether or not the value of the decremental timer $t_{AR}$ equals "0". If the decision in this step is No, that is, if the decremental timer $t_{AR}$ is in operation, then it means that the vehicle, which is in a state other than deceleration, is about to be accelerated, as is clear from the above description of the acceleration response control routine. In such a case, Step S801 is repeatedly executed until the value of the decremental timer $t_{AR}$ becomes "0"; as a result, latter-stage injection of fuel is inhibited and fuel is injected according to the former-stage injection control mode.

Sixthly, if the decision in Step S87 is Yes and thus the fuel injection control mode still remains undecided, it is determined in Step S88 whether or not the value of the decremental timer $t_{CR}$ equals "0". If the decision in this step is Yes, that is, if the decremental timer $t_{CR}$ is in operation, then it means that the fuel injection control mode has become outside the fuel-cut region on condition that the decremental timer $t_{DS}$ is not in operation, as will be understood from the above description of the control routine for recovery from fuel-cut and the deceleration shock control routine. In such a situation, Step S802 is executed, so that fuel is injected forcibly according to the latter-stage injection control mode. Since, during operation of the decremental timer $t_{DS}$, fuel is injected forcibly according to the latter-stage injection control mode, the output of the engine 1 does not suddenly increase, whereby roll of the engine 1, that is, vibration of the vehicle body, can be suppressed.

Seventhly, if the decision in Step S88 is Yes and thus the fuel injection control mode still remains undecided, a determination is made in the subsequent Step S89 as to whether or not the value of the decremental timer $t_{AS}$ equals "0" and at the same time the value of the decremental timer $t_{DS}$ equals "0", that is, whether or not either one of the decremental timers $t_{As}$ and $t_{DS}$ is in operation. If the decision in this step is No, then it means that the vehicle is going to accelerate following a decelerating state or the vehicle is going to decelerate following a constant-speed traveling state or accelerating state, as is clear from the foregoing description of the acceleration shock control routine and the deceleration shock control routine. Since, in such a situation, Step S802 is repeatedly executed, fuel is forcibly injected according to the latter-stage injection control mode (lean control). Consequently, the output of the engine 1 does not suddenly change and remains stable, regardless of depression of the accelerator pedal by the driver, that is, regardless of the intake air quantity, making it possible to lessen the acceleration or deceleration shock of the vehicle and permitting moderate acceleration or deceleration of the vehicle.

Eighthly, if the decision in Step S89 is Yes, Step S803 is executed, wherein the fuel injection control mode is determined in accordance with the aforementioned map of FIG. 5.

As explained above, when the fuel injection control mode is determined according to the injection control mode decision routine, the smoke flag $F_{SM}$, the cooling water temperature $T_{WT}$, the oil temperature $T_{TM}$ of the manual transmission 66, the start flag $F_{ST}$, the decremental timer $t_{AR}$ for acceleration response, the decremental timer $t_{CR}$ for recovery from fuel-cut, and the decremental timers $t_{AS}$ and $t_{DS}$ for controlling acceleration and deceleration shock, respectively, are checked for their values in the order mentioned, and based on the results, an applicable fuel injection control mode is preferentially determined. Accordingly, the fuel injection mode is determined taking account of factors which include the start of the engine 1, sufficiency of the braking force, reduction of smoke, quick completion of warm-up, reduction of rattling noise of the manual transmission 66, smoothness of vehicle start, acceleration response, response of recovery from fuel-cut, and reduction of acceleration or deceleration shock, in this order of priority. Namely, the start performance of the engine 1, the braking performance, and the vehicle start performance are given higher priority than the acceleration or deceleration shock reduction performance during travel of the vehicle, whereby the drivability of the vehicle can be further improved.

Injection Ending Time Control Routine

Figure 15:
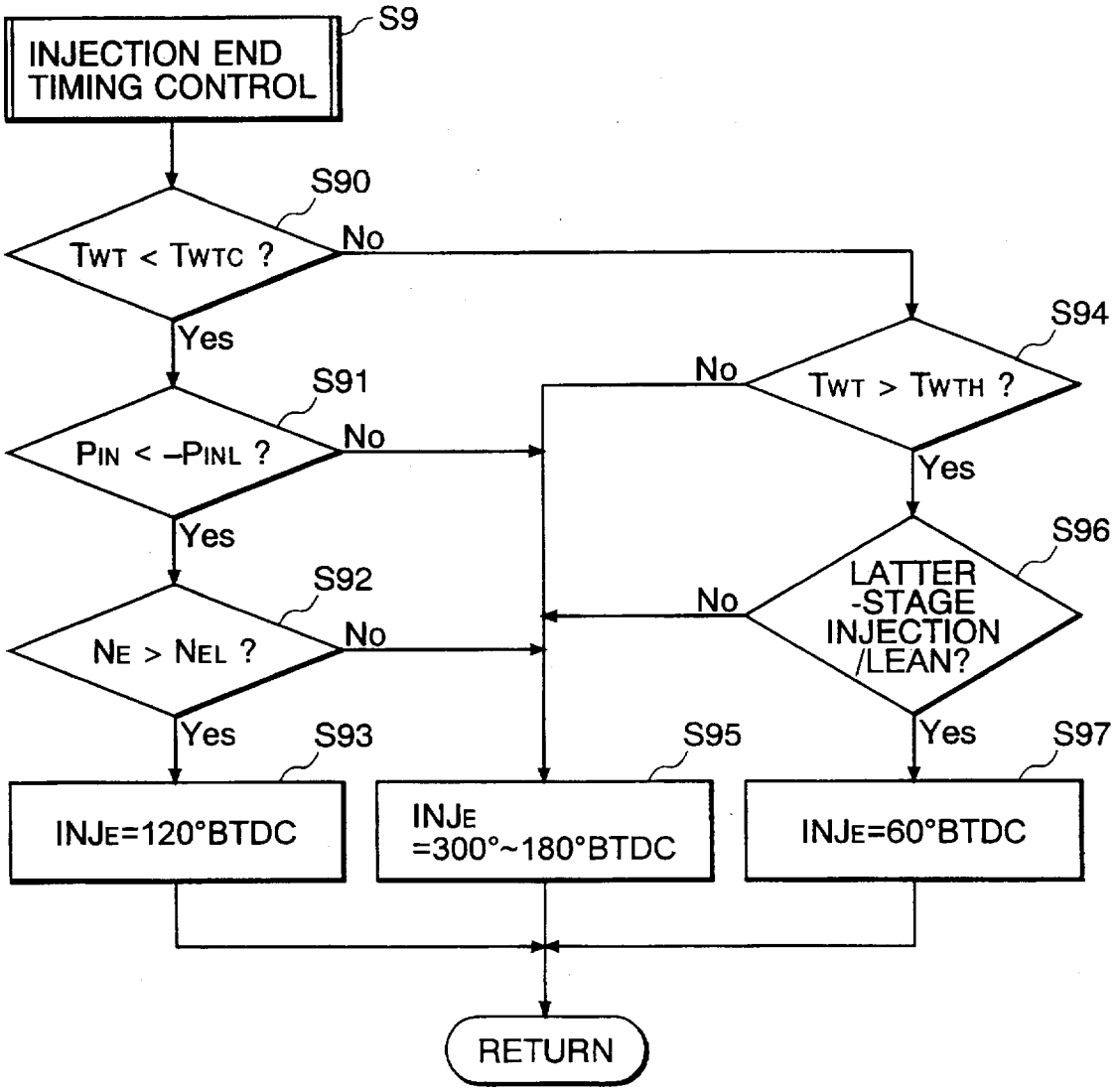
FIG. 15 is a flowchart showing details of an injection end timing control routine.

As shown in FIG. 15, in the injection ending time control routine, determinations are successively made in Steps S90, S91 and S92, and these determinations in Steps S90, S91 and S92 are identical respectively with Step S2 (FIG. 7) of the main routine and Steps S110 and S111 (FIG. 13) of the smoke control routine. Therefore, description of these Steps S90, S91 and S92 is omitted.

When the decisions in Steps S90, S91 and S92 are all Yes, that is, in a situation where the engine 1 is in a cold state, the engine load is small and at the same time the engine rotational speed $N_E$ is relatively high, a fuel injection ending time $INJ_E$ is set at a time before the top dead center (TDC) of the piston 7, for example, 120° (BTDC), in Step S93. In this case, since "0" has been set for the smoke flag $F_{SM}$, the latter-stage injection control mode (e.g., cold-state/low-load control) is forcibly selected as the fuel injection control mode, as is clear from the foregoing description of the smoke control routine and the injection control mode decision routine. By setting the fuel injection ending time $INJ_E$ at 120° BTDC in a situation like this, vaporization of fuel progresses sufficiently even if the quantity of injected fuel is relatively large, thus ensuring satisfactory combustion of fuel. Consequently, injection of fuel can be completed at the initial stage of the compression stroke, whereby smoke in the exhaust gas can be greatly cut down also because of the function of the aforementioned smoke control routine.

On the other hand, if the decision in Step S90 is No, it is determined in Step S94 whether or not the cooling water temperature $T_{WT}$ is higher than the predetermined temperature $T_{WTH}$ (e.g., 80° C.). If the decision in this step is No, then it means that the engine 1 is currently in warm-up operation, in which case the fuel injection ending time $INJ_E$ is set at a time falling within the range of 300° to 180° TDC in accordance with the operation control region (cf. map of FIG. 5) of the engine 1 which is determined based on the target average effective pressure $P_E$ and the engine rotational speed $N_E$. Namely, while the engine 1 is warming up at a temperature higher than or equal to the predetermined temperature, problems such as production of smoke do not arise, unlike the case where the engine 1 is in a cold, low-load state; therefore, the former-stage injection control mode is selected as the fuel injection control mode as mentioned above, in order to quicken the warm-up of the engine 1 and ensure stability of combustion.

Also when the decision in Step S91 or S92 is No, that is, when the engine 1 is in a cold state but an intake air negative pressure $P_{IN}$ is relatively high or the engine rotational speed $N_E$ is relatively low, Step S95 is executed and the former-stage injection control mode is selected as the fuel injection control mode. When the former-stage injection control mode is selected, the quantity of blowby gas sucked into the cylinders through the gaps of the piston rings decreases because the intake air negative pressure of the engine 1 is high, so that the blowby gas does not cause production of smoke. In a low-speed operation region of the engine 1, moreover, combustion of fuel is liable to deteriorate if the engine is in a cold state; therefore, the former-stage injection control mode which is advantageous in respect of formation of the mixture is selected.

If the decision in Step S94 is Yes, that is, if the warm-up of the engine 1 is completed, it is determined in the subsequent Step S96 whether or not the current fuel injection control mode is the latter-stage injection mode and at the same time the current air-fuel ratio control is the lean control. If the decision in this step is Yes, then the engine 1 is idling after completing the warm-up, and therefore, the fuel injection ending time $INJ_E$ is set at 60° BTDC, for example. In this case, although the injection ending time $INJ_E$ is set at the last stage of the compression stroke, the warm-up of the engine 1 is already completed and the quantity of fuel injected into the cylinders is small; therefore, fuel vaporizes and burns satisfactorily and the quantity of smoke in the exhaust gas does not increase.

Figure 16:
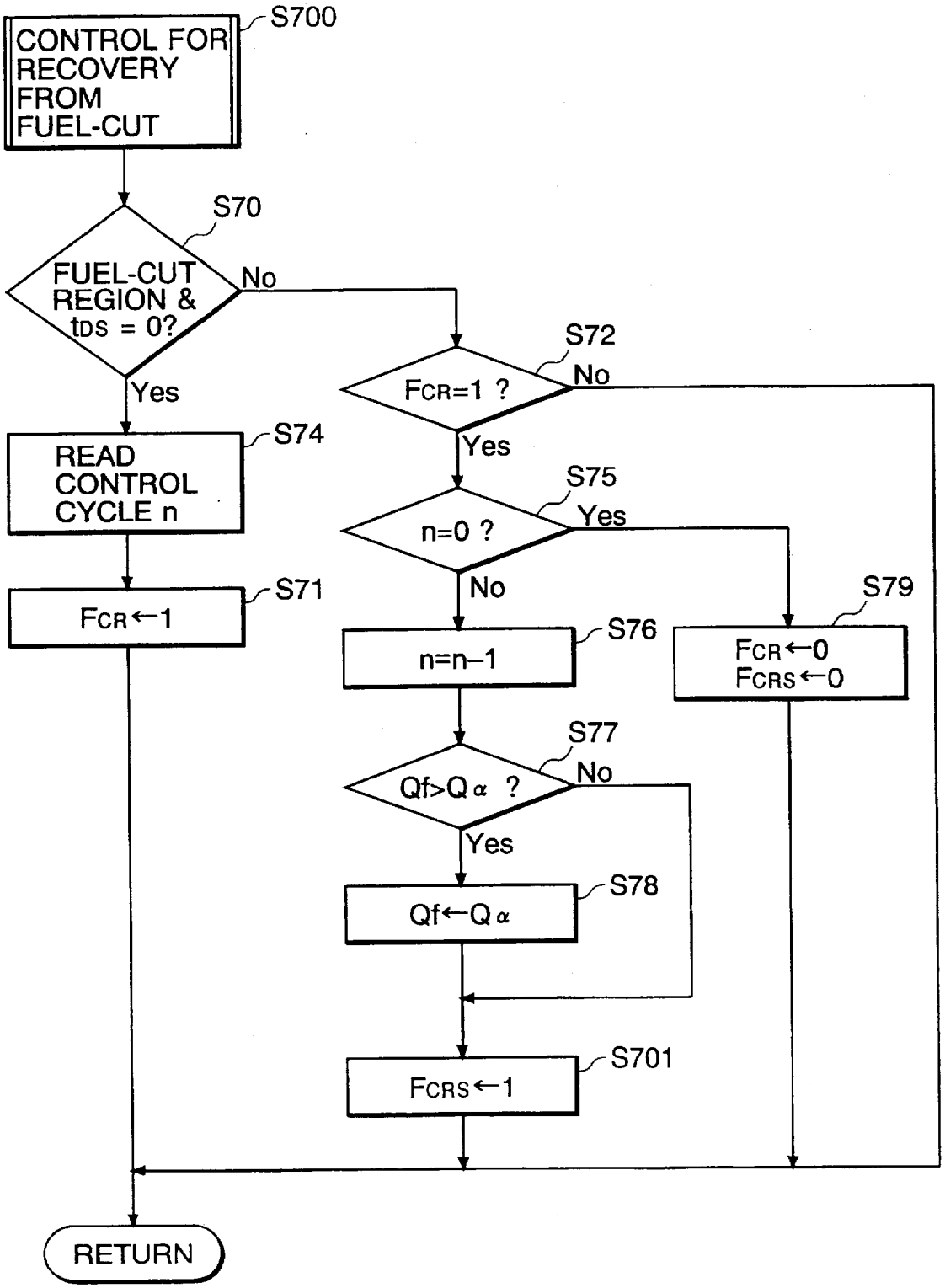
FIG. 16 is a flowchart showing a modification of the recovery control routine of FIG. 13.
Figure 17:
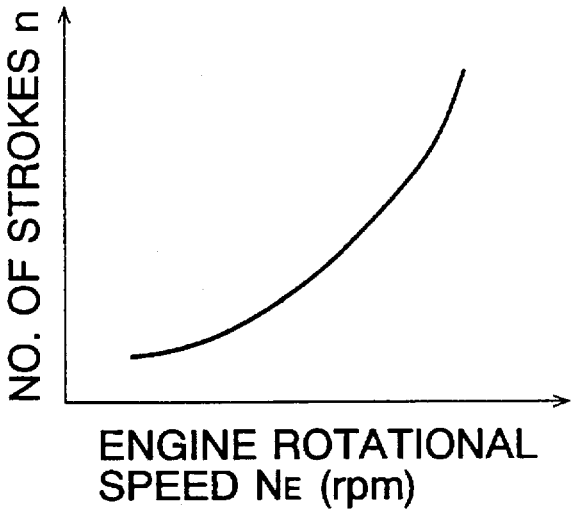
FIG. 17 is a graph showing the relationship between the engine rotational speed and the number of strokes.

This invention is not limited to the embodiment described above and may be modified in various ways. For example, FIG. 16 shows a modification of the routine for controlling recovery from fuel-cut. In the recovery control routine according to this modification, when the decision in the aforementioned Step S70 is Yes, a number n (n is an integer) of strokes of the engine 1 is read in Step S74. Specifically, the number n of strokes is read based on the engine rotational speed $N_E$ from the map shown in FIG. 17. As seen from the map of FIG. 17, the number n of strokes has a characteristic such that it takes a larger value with increase in the engine rotational speed $N_E$.

Then, in Step S71, "1" is set for the recovery flag $F_{CR}$. Namely, as long as the fuel injection control mode remains in the fuel-cut region and at the same time the value of the decremental timer $t_{DS}$ is held at "0", the number n of strokes is repeatedly read from the map of FIG. 17 and the value of the recovery flag $F_{CR}$ is held at "1".

On the other hand, if the decision in Step S70 is No, it is determined in Step S72 whether or not the value of the recovery flag $F_{CR}$ equals "1". If the decision in this step is Yes, that is, if the fuel injection control mode has become outside the fuel-cut region, a determination is made in the subsequent Step S75 as to whether or not the number n of strokes equals "0". Since at this point of time the decision in Step S75 becomes No, the number n of strokes is decremented by "1" (Step S76). In the next Step S77, it is determined whether or not a fuel injection quantity Qf is larger than a criterion value Qα. The fuel injection quantity Qf is determined in accordance with the air-fuel ratio control for the control region selected from the map of FIG. 5. The criterion value Qα indicates a fuel injection quantity for maintaining the average air-fuel ratio in the cylinders at a large air-fuel ratio (e.g., 20) relative to the stoichiometric air-fuel ratio, and is determined based on the target effective pressure $P_E$ and the engine rotational speed $N_E$.

If the decision in Step S77 is No, the fuel injection quantity Qf is maintained as it is; on the other hand, if the decision is Yes, the fuel injection quantity Qf is replaced by the criterion value Qα (Step S78), and "1" is set for a recovery start flag $F_{CRS}$ in Step S701.

When the decision in Step S75 becomes Yes after repeated execution of Step S76, the recovery flag $F_{CR}$ and the recovery start flag $F_{CRS}$ are both set to "0" in Step S79. As a result, in the subsequent control cycles, the decision in Step S72 becomes No and thus Step S75 and the following steps are skipped.

Figure 18:
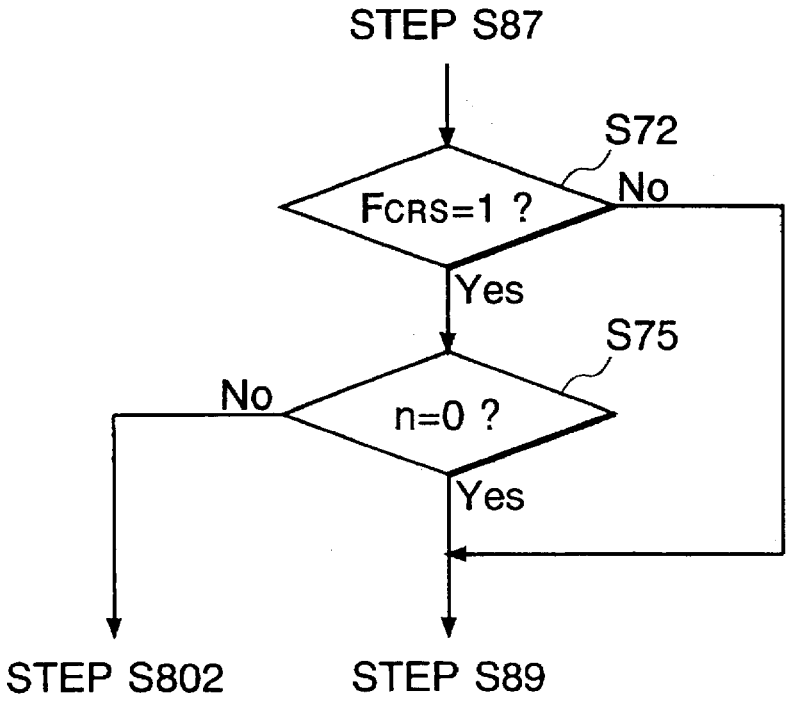
FIG. 18 is a diagram showing a part to be modified in the decision routine of FIG. 15 when the recovery control routine of FIG. 17 is executed.

In the case where the aforementioned recovery control routine of FIG. 16, instead of the recovery control routine of FIG. 12, is executed, Step S88 of the decision routine in FIG. 14 is replaced with Steps S804 and S805 in FIG. 18. First, in Steps S804 and S805, determinations are successively made as to whether or not the value of the recovery start flag $F_{CRS}$ equals "1" and whether or not the number n of strokes equals "0", respectively. If the decision in Step S804 is Yes and at the same time the decision in Step S805 is No, then it means that the control region for the engine 1 has become outside the fuel-cut region. In such a situation, the aforementioned Step S802 is repeatedly executed and thus the latter-stage injection control mode is forcibly set as the fuel injection control mode until the number n of strokes becomes "0".

Consequently, also in the case of the above recovery control routine and the decision routine according to the modification, when the control region for the engine 1 becomes outside the fuel-cut region, the latter-stage injection control mode is forcibly set as the fuel injection control mode until the number n of strokes becomes "0". Accordingly, the output of the engine 1 never suddenly increases, whereby acceleration shock of the vehicle and vibration of the vehicle body can be reduced. Further, even in a situation where the accelerator pedal is depressed to a large extent and the control region for the engine 1 becomes outside the fuel-cut region so that the former-stage injection control mode (stoichiometric feedback control or open-loop control) is selected as the fuel injection control mode, causing the probability of the fuel injection quantity suddenly increasing, the fuel injection quantity Qf is limited to the criterion value Qα, whereby the output of the engine 1 never suddenly increases.

Furthermore, the number n of strokes is set to a larger value with increase in the engine rotational speed $N_E$; therefore, when the control region for the engine 1 becomes outside the fuel-cut region while the engine rotational speed $N_E$ is high, the number n of control cycles is set to a correspondingly large value. In such a case, the substantial execution time of the recovery control routine is prolonged, making it possible to suppress fluctuation of the output torque of the engine 1.

Figure 19:
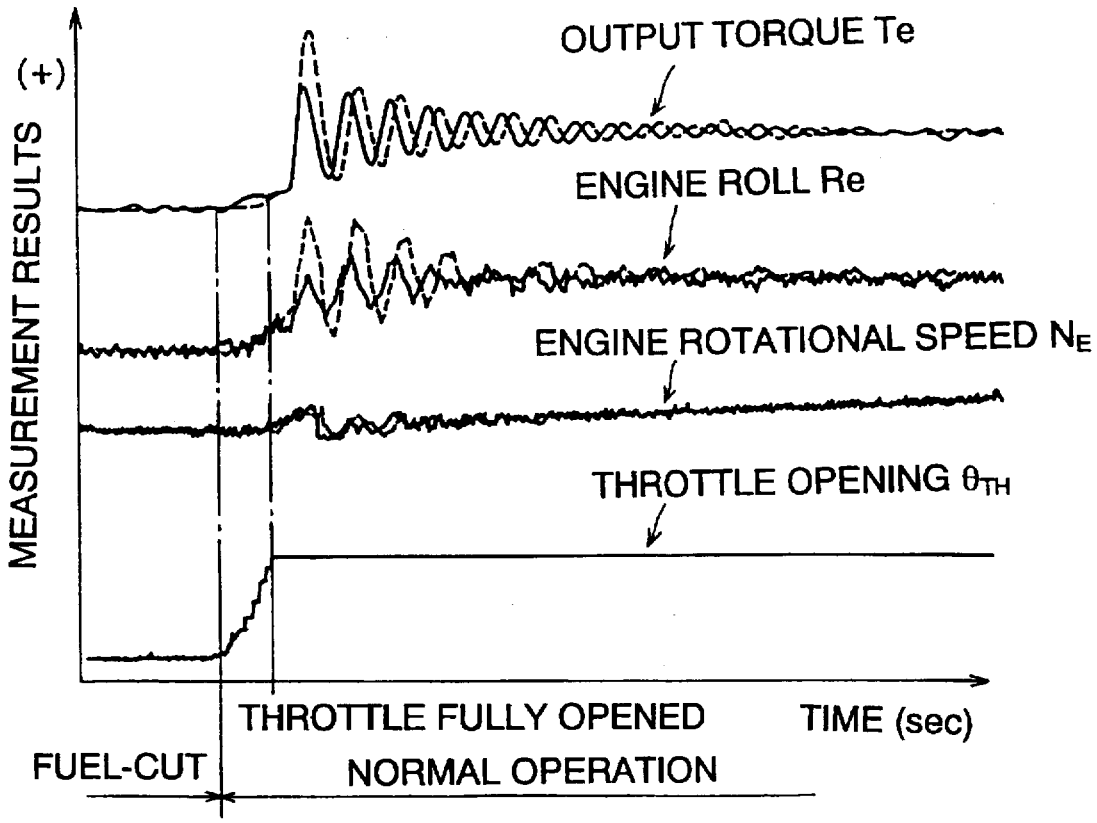
FIG. 19 is a graph showing results of measurement of operating states when engine operation recovers from a fuel-cut.

Referring to FIG. 19, there are shown, by the solid lines, the results of measurement of the engine rotational speed $N_E$, engine roll $R_E$ and engine output torque $T_E$ observed when the control region of the engine 1 recovers from the fuel-cut region with the throttle opening $\theta_{TH}$ set to wide or full opening. In FIG. 19, the broken lines indicate the case where the recovery control routine and Steps S804 and S805 of the decision routine are not executed. As is clear from FIG. 19, in the case where the recovery control routine and Steps S804 and S805 of the decision routine are executed, the output torque $T_E$ of the engine 1 does not acutely fluctuate and the roll $R_E$ of the engine 1 is greatly reduced, as compared with the measurement results indicated by the broken lines. In this case, moreover, the engine rotational speed $N_E$ scarcely changes.

This invention is not limited to the foregoing embodiment and may be modified in various ways. For example, this invention is applicable not only to in-line four-cylinder engine but also to various types of cylinder-injection engines having a different number of cylinders or different arrangement of cylinders, such as single-cylinder engine or V-type six-cylinder engine. Also, the fuel to be used is not limited to gasoline and may be methanol. To detect the vehicle start, the throttle opening velocity $\Delta\theta_{TH}$ may be used instead of the throttle opening $\theta_{TH}$, and to detect the idling operation of the engine 1, the output signal from the idle switch 30 may be used.

A boost sensor for detecting the intake air pressure in the surge tank may be used in place of the airflow sensor 64, and a single air bypass valve may be used in place of the air bypass valves 24 and 27. Also, in the case where the throttle valve is actuated by a motor, the opening of the throttle valve may be controlled in such a manner that the throttle valve itself functions as the air bypass valve. In this case, a sensor for detecting the amount of depression of the accelerator pedal is used in place of the throttle opening sensor.

Although in the recovery control routine of FIG. 16, the number n of strokes is used in lieu of a decremental timer, it may be used also in the other control routines in place of the decremental timers. Also, the initial values set in the decremental timers of the individual control routines may be varied in accordance with the engine rotational speed $N_E$.

Further, the various predetermined values mentioned above are suitably set in accordance with the specification of the overall system including the engine, and thus are not restricted to the specific values given above by way of example.

We claim:

1. A fuel injection control apparatus for a cylinder-injection type internal combustion engine, comprising:

operating state detecting means for detecting operating states of the internal combustion engine;

control mode switching means for performing a switching between a former-stage injection control mode in which fuel is injected during a suction stroke and a latter-stage injection control mode in which fuel is injected during a compression stroke, in accordance with a detection result provided by said operating state detecting means;

transitional state detecting means for detecting transitional operating states of the internal combustion engine; and control mode selecting means, which takes priority over said control mode switching means when a transitional operating state of the internal combustion engine is detected by said transitional state detecting means, for selecting a fuel injection control mode suited for the detected transitional operating state.

2. The fuel injection control apparatus for a cylinder-injection type internal combustion engine according to claim 1, wherein said the operating states of the internal combustion engine include a fuel-cut region in which injection of fuel is suspended under a predetermined operation condition, said transitional state detecting means detects, as one of the transitional operating states to be detected, a transitional recovering state in which operation of the internal combustion engine recovers from the fuel-cut region, and said control mode selecting means sustains the injection control mode selected thereby for a predetermined time period when the transitional recovering state is detected by said transitional state detecting means, in such a manner that in the selected injection control mode, an air-fuel ratio is set to a value greater than a stoichiometric air-fuel ratio.

3. The fuel injection control apparatus for a cylinder-injection type internal combustion engine according to claim 1, wherein said transitional state detecting means detects, as one of the transitional operating states to be detected, a first transitional accelerating state in which operation of the internal combustion engine changes from a decelerating state to an accelerating state, and said control mode selecting means sustains the injection control mode selected thereby for a predetermined time period when the first transitional accelerating state is detected by said transitional state detecting means, in such a manner that in the selected injection control mode, an air-fuel ratio is set to a value greater than a stoichiometric air-fuel ratio.

4. The fuel injection control apparatus for a cylinder-injection type internal combustion engine according to claim 3, wherein said transitional state detecting means includes load information detecting means for detecting load information of the internal combustion engine, opening information detecting means for detecting a change in opening of a throttle valve of the internal combustion engine, and judging means for judging that the internal combustion engine is in the first transitional accelerating state when the load information detected by said load information detecting means shows a change in a positive direction beyond a predetermined negative value and also the change in opening of the throttle valve detected by said opening information detecting means indicates a change in a positive direction beyond a predetermined positive value.

5. The fuel injection control apparatus for a cylinder-injection type internal combustion engine according to claim 1, characterized in that said transitional state detecting means detects, as one of the transitional operating states to be detected, a transitional decelerating state in which operation of the internal combustion engine changes to a decelerating state, and said control mode selecting means sustains the injection control mode selected thereby for a predetermined time period when the transitional decelerating state is detected by said transitional state detecting means, in such a manner that in the selected injection control mode, an air-fuel ratio is set to a value greater than a stoichiometric air-fuel ratio.

6. The fuel injection control apparatus for a cylinder-injection type internal combustion engine according to claim 5, wherein said transitional state detecting means includes opening information detecting means for detecting a change in opening of a throttle valve of the internal combustion engine, and judging means for judging that the internal combustion engine is in the transitional decelerating state when the change in opening of the throttle valve detected by said opening information detecting means indicates a change in a negative direction beyond a predetermined negative value.

7. The fuel injection control apparatus for a cylinder-injection type internal combustion engine according to any one of claims 2 through 6, wherein selected injection control mode is the latter-stage injection control mode.

8. The fuel injection control apparatus for a cylinder-injection type internal combustion engine according to claim 1, wherein said transitional state detecting means detects, as one of the transitional operating states to be detected, a second transitional accelerating state in which operation of the internal combustion engine changes from a state other than a decelerating state to an accelerating state, and said control mode selecting means selects the former-stage injection control mode as the injection control mode for a predetermined time period when the second transitional accelerating state is detected by said transitional state detecting means.

9. The fuel injection control apparatus for a cylinder-injection type internal combustion engine according to claim 8, said transitional state detecting means includes opening information detecting means for detecting a change in opening of a throttle valve of the internal combustion engine, and judging means for judging that the internal combustion engine is in the second transitional accelerating state when the change in opening of the throttle valve detected by said opening information detecting means indicates a change in a positive direction beyond a predetermined positive value.

10. The fuel injection control apparatus for a cylinder-injection type internal combustion engine according to any one of claims 2 through 6, characterized in that the predetermined time period is set as a number of strokes of the internal combustion engine.

11. The fuel injection control apparatus for a cylinder-injection type internal combustion engine according to claim 10, wherein the number of strokes takes a greater value with increase in rotational speed of the internal combustion engine.

12. The fuel injection control apparatus for a cylinder-injection type internal combustion engine according to claim 1, wherein said transitional state detecting means detects, as one of the transitional operating states to be detected, a transitional starting state in which a vehicle equipped with the internal combustion engine is going to start, and said control mode selecting means selects the former-stage injection control mode as the injection control mode for a predetermined time period when the transitional starting state is detected by said transitional state detecting means.

13. The fuel injection control apparatus for a cylinder-injection type internal combustion engine according to claim 12, further comprising stop detecting means for detecting a stopped state of the vehicle, and wherein said control mode switching means switches the injection control mode to the latter-stage injection control mode when the stopped state of the vehicle is detected by said stop detecting means.

14. The fuel injection control apparatus for a cylinder-injection type internal combustion engine according to claim 12 or 13, wherein said transitional state detecting means includes vehicle speed detecting means for detecting a speed of the vehicle, idle detecting means for detecting an idling state of the internal combustion engine, and start judging means for judging that the vehicle is in the transitional starting state when the vehicle speed detected by said vehicle speed detecting means is lower than a predetermined value and also the idling state of the internal combustion engine is not detected by said idle detecting means.

15. The fuel injection control apparatus for a cylinder-injection type internal combustion engine according to claim 12 or 13, wherein said stop detecting means includes vehicle speed detecting means for detecting a speed of the vehicle, idle detecting means for detecting an idling state of the internal combustion engine, and stop judging means for judging that the vehicle is in the stopped state when the vehicle speed detected by said vehicle speed detecting means is lower than a predetermined value and also the idling state of the internal combustion engine is detected by said idle detecting means.

16. The fuel injection control apparatus for a cylinder-injection type internal combustion engine according to claim 12 or 13, further comprising start completion detecting means for detecting completion of start of the vehicle, and means for causing said control mode switching means to switch the fuel injection control mode when the completion of start of the vehicle is detected by said start completion detecting means.

17. The fuel injection control apparatus for a cylinder-injection type internal combustion engine according to claim 16, wherein said start completion detecting means includes vehicle speed detecting means for detecting a speed of the vehicle, and judging means for judging that the start of the vehicle is completed when the vehicle speed detected by said Vehicle speed detecting means has become greater than a predetermined value.

18. The fuel injection control apparatus for a cylinder-injection type internal combustion engine according to claim 1, further comprising an electric low-pressure pump for feeding fuel of a predetermined pressure toward the internal combustion engine, a high-pressure pump, driven mechanically by the internal combustion engine, for feeding fuel of a higher pressure than the predetermined pressure toward the internal combustion engine, and fuel-pressure switching means having a first operating position for supplying low-pressure fuel to the internal combustion engine and a second operating position for supplying high-pressure fuel to the internal combustion engine, and switched to one of the first and second operating positions in accordance with the operating state of the internal combustion engine, wherein said transitional state detecting means detects, as one of the transitional operating states to be detected, a pressure transition state in which said fuel-pressure switching means is situated at the first operating position, and said control mode selecting means selects the former-stage injection control mode as the injection-control mode for a predetermined time period when the pressure transition state is detected by said transitional state detecting means.

19. The fuel injection control apparatus for a cylinder-injection type internal combustion engine according to claim 1, wherein said internal combustion engine is installed in a vehicle which is provided with a manual transmission coupled to the internal combustion engine via a clutch having a two-stage torsion characteristic and transmission temperature detecting means for detecting a temperature of the manual transmission, said transitional state detecting means detects, as one of the transitional operating states to be detected, a transmission temperature transition state in which the transmission temperature detected by said transmission temperature detecting means becomes lower than a predetermined temperature, and said control mode selecting means selects the former-stage injection control mode as the injection control mode when the transmission temperature transition state is detected by said transitional state detecting means.

20. The fuel injection control apparatus for a cylinder-injection type internal combustion engine according to claim 19, wherein said transmission temperature detecting means detects a lubricating oil temperature of the manual transmission.

21. The fuel injection control apparatus for a cylinder-injection type internal combustion engine according to claim 1, wherein said operating state detecting means includes cold-state detecting means for detecting a cold state of the internal combustion engine, load information detecting means for detecting load information of the internal combustion engine, and engine rotational speed detecting means for detecting a rotational speed of the internal combustion engine, said transitional state detecting means detects, as one of the transitional operating states to be detected, a first transitional cooling state in which the cold state of the internal combustion engine is detected by said cold-state detecting means and also the load information detected by said load information detecting means has become smaller than a predetermined value, and said control mode selecting means selects the latter-stage injection control mode as the injection control mode when the first transitional cooling state is detected by said transitional state detecting means.

22. The fuel injection control apparatus for a cylinder-injection type internal combustion engine according to claim 21, wherein, in the latter-stage injection control mode, injection of fuel is terminated in an initial stage of the compression stroke.

23. The fuel injection control apparatus for a cylinder-injection type internal combustion engine according to claim 1, wherein said operating state detecting means includes intake air temperature detecting means for detecting an intake air temperature of the internal combustion engine, and cold-state detecting means for detecting a cold state of the internal combustion engine, said transitional state detecting means includes varying means for varying a threshold of said cold-state detecting means, which threshold is used for detecting the cold state of the internal combustion engine, in accordance with the intake air temperature detected by said intake air temperature detecting means, and detects, as one of the transitional operating states to be detected, a second transitional cooling state in which the cold state of the internal combustion engine is detected by said cold-state detecting means, and said control mode selecting means selects the former-stage injection control mode as the injection control mode when the second transitional cooling state is detected by said transitional state detecting means.

24. The fuel injection control apparatus for a cylinder-injection type internal combustion engine according to claim 1, wherein said transitional operating states include a transitional recovering state in which operation of the internal combustion engine recovers from a fuel cut region, a first transitional accelerating state in which operation of the internal combustion engine changes from a decelerating state to an accelerating state, a transitional decelerating state in which operation of the internal combustion engine changes to a decelerating state, a second transitional accelerating state in which operation of the internal combustion engine changes from a state other than the decelerating state to the accelerating state, a transitional starting state in which a vehicle equipped with the internal combustion engine is going to start, a first transitional cooling state in which a first cold state of the internal combustion engine is detected when load of the internal combustion engine becomes smaller than a predetermined value, and a second transitional cooling state of the internal combustion engine in which a second cold state is detected in accordance with an intake air temperature, and wherein said control mode selecting means includes determining means for preferentially selecting the injection control mode by giving priority in order of the first transitional cooling state, the second transitional cooling state, the second transitional accelerating state, the transitional recovering state, and the first transitional accelerating state or the transitional decelerating state.

25. A cylinder-injection type internal combustion engine comprising:

operating state detecting means for detecting an operating state of the internal combustion engine;

fuel supply means for injecting fuel directly into a combustion chamber of the internal combustion engine;

first fuel injection mode setting means for setting a first injection mode in which fuel injection is carried out mainly during a compression stroke to obtain a lean air-fuel mixture when an engine temperature detected by said operating state detecting means is higher than a predetermined temperature and also a load detected by said operating state detecting means is smaller than or equal to a preset load, or a second injection mode in which fuel injection is carried out mainly during a suction stroke to obtain a richer air-fuel mixture than in the first injection mode when the load has exceeded the preset load, said first fuel injection mode setting means selecting the second injection mode when the engine temperature is lower than or equal to the predetermined temperature;

fuel injection timing control means for driving said fuel supply means in accordance with the individual injection modes set by said first fuel injection mode setting means, to control fuel supply timing; and second fuel injection mode setting means for setting specific fuel injection mode corresponding to a specific operating state of the internal combustion engine when the specific operating state is detected by said operating state detecting means, wherein, when the specific operating state is detected, said fuel injection timing control means controls the fuel supply timing in accordance with the specific injection mode set by said second fuel injection mode setting means preferentially over the first or second injection mode set by said first fuel injection mode setting means.

26. The cylinder-injection type internal combustion engine according to claim 25, further comprising transitional operating state detecting means for detecting, as the specific operating state, a transitional operating state in which the operating state of the internal combustion engine changes.

27. The cylinder-injection type internal combustion engine according to claim 26, wherein said transitional operating state detecting means includes opening change detecting means for detecting a change in opening of a throttle valve of the internal combustion engine.

28. The cylinder-injection type internal combustion engine according to claim 26, wherein said second fuel injection mode setting means sets a third injection mode in which fuel injection is suspended when a no-load operating state of the internal combustion engine is detected by said transitional operating state detecting means in a medium/high rotation region of the internal combustion engine.

29. The cylinder-injection type internal combustion engine according to claim 28, wherein said second fuel injection mode setting means sets a fourth injection mode in which fuel injection is carried out according to the first injection mode when a restart of fuel injection attributable to a decrease in rotational speed of the internal combustion engine is detected by said transitional operating state detecting means during execution of the third injection mode.

30. The cylinder-injection type internal combustion engine according to claim 28, wherein said second fuel injection mode setting means sets a fifth injection mode in which fuel injection is carried out according to the first injection mode, for a predetermined time period when a transition to an accelerating state of the internal combustion engine is detected by said transitional operating state detecting means during execution of the third injection mode.

31. The cylinder-injection type internal combustion engine according to claim 26, wherein said second fuel injection mode setting means sets a fifth injection mode in which fuel injection is carried out according to the first injection mode, for a predetermined time period when a transition to a decelerating state of the internal combustion engine is detected by said transitional operating state detecting means during execution of the second injection mode.

32. The cylinder-injection type internal combustion engine according to claim 26, wherein said second fuel injection mode setting means sets a sixth injection mode in which fuel injection is carried out according to the second injection mode, for a predetermined time period when a transition to an accelerating state of the internal combustion engine is detected by said transitional operating state detecting means during execution of the first injection mode.

33. The cylinder-injection type internal combustion engine according to any one of claims 30 through 32, wherein predetermined time period is set as a number of strokes of the internal combustion engine.

34. The cylinder-injection type internal combustion engine according to claim 26, wherein said second fuel injection mode setting means sets the first injection mode when a substantially stopped state of a vehicle is detected by said operating state detecting means.

35. The cylinder-injection type internal combustion engine according to claim 34, wherein said second fuel injection mode setting means sets a seventh injection mode in which the first injection mode is immediately switched to the second injection mode to carry out fuel injection when a transition from a stopped state to a starting state of the vehicle is detected by said transitional operating state detecting means.

36. The cylinder-injection type internal combustion engine according to claim 35, wherein said transitional operating state detecting means includes vehicle speed detecting means for detecting a running state of the vehicle, and start judging means having idle detecting means for detecting an idling state of the internal combustion engine, and said start judging means judges that the vehicle is in the substantially stopped state when a vehicle speed detected by said vehicle speed detecting means is lower than a first preset speed and also the idling state of the internal combustion engine is detected by said idle detecting means, and said start judging means judges that the vehicle has begun to move when a deviation from the idling state of the internal combustion engine is detected by said idle detecting means.

37. The cylinder-injection type internal combustion engine according to claim 36, wherein said transitional operating state detecting means includes start completion judging means having vehicle speed detecting means for detecting a running speed of the vehicle, and wherein said start completion judging means judges that start of the vehicle has completed when the running speed of the vehicle detected by said vehicle speed detecting means has exceeded a second preset speed.

38. The cylinder-injection type internal combustion engine according to claim 37, wherein, when completion of start of the vehicle is detected by said start completion judging means, said fuel injection timing control means controls said fuel supply means in accordance with the seventh injection mode set by said second fuel injection mode setting means and then with the injection mode set by said first fuel injection mode setting means.

39. The cylinder-injection type internal combustion engine according to claim 25, wherein said second fuel injection mode setting means sets the first injection mode when the internal combustion engine is in a specific operating state in which the engine temperature is lower than or equal to the predetermined temperature and also the load is smaller than or equal to the preset load.

40. The cylinder-injection type internal combustion engine according to claim 25, wherein said second fuel injection mode setting means sets the second injection mode when the internal combustion engine is in a specific operating state in which the engine temperature is lower than or equal to the predetermined temperature and also an intake air temperature is lower than or equal to a preset intake air temperature.

41. A fuel injection control apparatus for a cylinder-injection type internal combustion engine according to claim 7, characterized in that the predetermined time period is set as a number of strokes of the internal combustion engine.

42. A fuel injection control apparatus for a cylinder-injection type internal combustion engine according to claim 8 or 9, characterized in that the predetermined time period is set as a number of strokes of the internal combustion engine.

43. The fuel injection control apparatus for a cylinder-injection type internal combustion engine according to claim 41, wherein said number of strokes takes a greater value with increase in rotational speed of the internal combustion engine.

44. The fuel injection control apparatus for a cylinder-injection type internal combustion engine according to claim 42, wherein said number of strokes takes a greater value with increase in rotational speed of the internal combustion engine.

* * * * *